US010588424B2

(12) United States Patent
Sclare et al.

(10) Patent No.: US 10,588,424 B2
(45) Date of Patent: Mar. 17, 2020

(54) CONVERTIBLE HIGH CHAIR

(71) Applicant: KIDS II, INC., Atlanta, GA (US)

(72) Inventors: Jacob Sclare, Dacula, GA (US); Chaitanya Tadipatri, Alpharetta, GA (US)

(73) Assignee: KIDS2, INC., Atlanta, GA (US)

( * ) Notice: Subject to any disclaimer, the term of this patent is extended or adjusted under 35 U.S.C. 154(b) by 124 days.

(21) Appl. No.: 15/450,359

(22) Filed: Mar. 6, 2017

(65) Prior Publication Data

US 2017/0251826 A1 Sep. 7, 2017
US 2019/0059609 A9 Feb. 28, 2019

Related U.S. Application Data

(63) Continuation-in-part of application No. 15/137,335, filed on Apr. 25, 2016, now abandoned.

(60) Provisional application No. 62/304,653, filed on Mar. 7, 2016, provisional application No. 62/394,958, filed on Sep. 15, 2016, provisional application No. 62/152,845, filed on Apr. 25, 2015, provisional application No. 62/215,943, filed on Sep. 9, 2015.

(51) Int. Cl.

| | |
|---|---|
| ***A47D 1/04*** | (2006.01) |
| ***A47D 1/10*** | (2006.01) |
| ***A47D 1/00*** | (2006.01) |
| ***A47D 1/02*** | (2006.01) |

(52) U.S. Cl.

CPC ..... *A47D 1/04* (2013.01); *A47D 1/004* (2013.01); *A47D 1/008* (2013.01); *A47D 1/02* (2013.01); *A47D 1/10* (2013.01); *A47D 1/103* (2013.01)

(58) Field of Classification Search

CPC ..... A47D 1/004; A47D 1/008; A47D 1/02; A47D 1/04; A47D 1/10; A47D 1/103

See application file for complete search history.

(56) References Cited

U.S. PATENT DOCUMENTS 451,058 A * 4/1891 Koeser ..... A47D 1/008 297/155
2,491,465 A 12/1949 Johnson
(Continued)

FOREIGN PATENT DOCUMENTS

DE 102015122122 A1 6/2016
EP 1396216 A1 3/2004
(Continued)

OTHER PUBLICATIONS

Partial European Search Report for EP App. No. 17159748.7; dated Sep. 6, 2017; 12 pgs.

*Primary Examiner* — James M Ference
(74) *Attorney, Agent, or Firm* — Gardner Groff & Greenwald, PC

(57) ABSTRACT

Various embodiments of the present invention are directed to a convertible children's high chair. According to various embodiments, the convertible high chair generally includes a first child seat supported above a floor by a high chair frame, and a second child seat configured for being removably coupled to the first child seat. The second child seat is configured such that, when detached from the high chair's first child seat, it can be used as a booster seat. In certain embodiments, the second child seat includes a base surface configured to stably support the second child seat on a separate support surface.

9 Claims, 32 Drawing Sheets

(56) References Cited

U.S. PATENT DOCUMENTS 2,496,205 A * 1/1950 Grieb ..... A47D 1/103 297/250.1
2,516,774 A * 7/1950 Gottfried ..... A47D 1/004 297/134
2,529,687 A * 11/1950 Greenbaum ..... A47B 83/02 297/134
2,667,207 A * 1/1954 Magyar ..... A47D 1/004 108/11
2,672,182 A * 3/1954 Gwin ..... A47D 1/008 108/90
2,731,072 A 1/1956 Post
2,799,324 A * 7/1957 Anderson ..... A47D 1/008 16/231
2,971,567 A 2/1961 Kimmel
2,984,291 A 5/1961 Kostenborder et al.
3,146,738 A 9/1964 Telarico
3,181,483 A * 5/1965 Devitt ..... A47B 23/00 108/159
3,649,074 A 3/1972 McDonald et al.
D229,999 S 1/1974 Blazey et al.
4,288,123 A 9/1981 Cone
4,591,206 A * 5/1986 Pribble ..... A47C 7/70 297/148
4,722,570 A 2/1988 Bertoli
4,795,209 A * 1/1989 Quinlan, Jr. ..... A47D 1/008 297/153
4,854,638 A * 8/1989 Marcus ..... A47D 1/103 297/256.11
4,927,024 A * 5/1990 Lloyd ..... A47D 1/008 206/562
D327,200 S 6/1992 Szablak et al.
5,183,311 A 2/1993 Meeker et al.
5,238,292 A 8/1993 Golenz et al.
5,265,931 A 11/1993 Ryan
5,332,241 A 7/1994 Rho
5,348,374 A 9/1994 Kuo
5,375,869 A 12/1994 Hsiao
D358,730 S 5/1995 Meeker et al.
5,474,355 A 12/1995 Lerner et al.
5,507,550 A 4/1996 Maloney
5,509,719 A 4/1996 Cone, II
5,527,090 A * 6/1996 Cone, II ..... A47D 1/008 297/149
5,564,778 A 10/1996 Shimer et al.
5,586,800 A * 12/1996 Triplett ..... A47D 1/008 108/26
5,658,047 A 8/1997 Ratza et al.
5,707,104 A 1/1998 Perego
5,720,226 A * 2/1998 Padovano ..... A47B 23/002 108/25
5,765,909 A 6/1998 Catrinar
5,772,279 A 6/1998 Johnson, Jr.
5,806,922 A * 9/1998 Mendelovich ..... A47D 1/004 297/119
5,810,432 A * 9/1998 Haut ..... A47D 1/008 297/153
5,820,207 A 10/1998 Wang
5,823,615 A 10/1998 Haut
5,836,652 A 11/1998 Wexler et al.
5,951,102 A * 9/1999 Poulson ..... A47D 1/004 297/130
5,984,791 A * 11/1999 Fair ..... A47D 13/105 297/155
5,992,932 A * 11/1999 Kain ..... A47D 1/004 297/151
6,007,400 A 12/1999 Lan
6,036,268 A 3/2000 Larson
6,050,643 A 4/2000 Kain et al.
6,082,814 A * 7/2000 Celestina-Krevh ..... A47D 1/04 297/118
6,089,653 A 7/2000 Hotaling et al.
D428,715 S 8/2000 Brevi
6,129,414 A 10/2000 Brevi
D435,196 S 12/2000 Gregor et al.
6,161,898 A 12/2000 Brevi
6,189,973 B1 2/2001 Wu
6,212,706 B1 4/2001 Rossman et al.
6,237,996 B1 5/2001 Chen et al.
6,298,793 B1 * 10/2001 Turner ..... A47D 1/008 108/26
6,318,804 B1 11/2001 Brown
6,347,830 B1 2/2002 Chen
6,347,833 B1 2/2002 Chen
D454,007 S 3/2002 Huang
6,367,875 B1 4/2002 Bapst
6,398,304 B1 6/2002 Chen et al.
6,415,460 B1 7/2002 Rossman et al.
6,416,124 B1 * 7/2002 Chen ..... A47D 1/008 297/149
6,419,312 B1 * 7/2002 Flannery ..... A47D 1/008 297/148
6,421,901 B2 7/2002 Sitarski et al.
6,428,099 B1 8/2002 Kain
6,484,989 B1 * 11/2002 Connery ..... A47D 1/008 108/26
6,497,452 B2 * 12/2002 Catelli ..... A47D 1/008 297/148
6,511,123 B1 1/2003 Sitarski et al.
6,595,583 B2 7/2003 Hou
D478,219 S 8/2003 Greger
6,659,544 B2 12/2003 Hollett et al.
6,666,505 B2 12/2003 Greger et al.
6,715,827 B1 4/2004 Chen
6,773,064 B2 8/2004 Treen et al.
6,832,813 B2 12/2004 Tomas et al.
6,851,375 B2 2/2005 Guard et al.
6,877,801 B2 4/2005 Asbach et al.
6,899,394 B2 5/2005 Wang
6,920,830 B1 * 7/2005 Asbach ..... A47D 1/008 108/26
6,932,426 B2 8/2005 Greger
6,951,371 B2 10/2005 Wang
7,011,363 B1 * 3/2006 Connery ..... A47D 1/008 297/148
7,029,064 B2 4/2006 Chen
7,066,542 B2 6/2006 Wang
7,128,367 B2 10/2006 You et al.
7,134,714 B1 11/2006 Connery
7,201,445 B1 4/2007 Dubiel et al.
7,261,370 B1 * 8/2007 Whitesell, Jr. ..... A47D 1/004 297/153
7,300,103 B1 11/2007 Grays
7,314,247 B1 1/2008 Chen et al.
7,318,380 B2 1/2008 Guard et al.
7,328,941 B2 2/2008 Asbach et al.
7,334,836 B2 2/2008 Chen
7,364,235 B2 4/2008 Chen et al.
7,393,050 B2 7/2008 Li
7,441,835 B2 10/2008 Chen et al.
D579,673 S 11/2008 Mancuso et al.
7,472,959 B1 1/2009 Ratza et al.
7,490,558 B2 2/2009 Asbach et al.
7,490,895 B2 2/2009 Yeh
D594,667 S 6/2009 Wang
7,540,560 B1 6/2009 Connery
7,568,758 B2 8/2009 Troutman et al.
7,658,446 B2 2/2010 Meeker et al.
7,673,934 B2 3/2010 Bearup et al.
7,695,060 B2 4/2010 Dubiel et al.
7,735,911 B2 6/2010 Chen
D618,925 S 7/2010 Fiore, Jr. et al.
7,753,448 B2 7/2010 Chen et al.
7,810,885 B2 10/2010 Chen et al.
7,832,801 B2 11/2010 Driessen
7,871,125 B2 1/2011 Asbach et al.
7,878,584 B2 * 2/2011 Hu ..... A47D 15/006 297/148
7,883,145 B2 2/2011 Troutman et al.
7,896,431 B2 3/2011 Cui et al.
7,918,497 B2 * 4/2011 Keegan ..... A47D 1/008 297/118

(56) References Cited

U.S. PATENT DOCUMENTS 7,922,244 B2 4/2011 Bearup
D642,815 S 8/2011 Kelly et al.
7,992,714 B1 * 8/2011 Devault ..... A47G 19/10 108/26
8,007,043 B1 8/2011 Vuong
8,011,722 B2 9/2011 Cui et al.
8,029,053 B2 10/2011 Troutman et al.
8,100,470 B1 1/2012 Hu
8,141,943 B2 3/2012 Hu et al.
8,157,327 B2 4/2012 Tomasi
8,162,390 B2 4/2012 Zhong
8,172,253 B2 5/2012 Song
8,201,879 B2 6/2012 Hartenstine et al.
8,226,161 B2 7/2012 Fiore, Jr. et al.
8,256,833 B2 9/2012 Hu et al.
8,287,044 B2 10/2012 Chen et al.
8,292,365 B2 10/2012 Lu et al.
8,308,229 B2 * 11/2012 Galley ..... A47D 1/10 297/118
8,308,230 B2 11/2012 Zhong
8,360,514 B2 1/2013 Chen et al.
8,376,375 B2 2/2013 Mival et al.
8,376,461 B2 2/2013 Chen
D677,912 S 3/2013 Gillett et al.
8,419,121 B2 4/2013 Hu et al.
8,454,049 B2 6/2013 Chen et al.
8,540,312 B2 9/2013 Asbach et al.
8,567,866 B2 10/2013 Carimati Di Carimate et al.
8,567,867 B2 * 10/2013 Arnold, IV ..... A47D 1/002 297/250.1
8,602,490 B2 12/2013 Tsai et al.
D699,955 S 2/2014 Chen
8,646,838 B2 2/2014 Fiore, Jr. et al.
8,651,572 B2 * 2/2014 Medeiros ..... A47D 1/002 297/256.1
8,696,055 B2 4/2014 Stolarz et al.
8,752,903 B2 6/2014 Ponticelli
8,789,882 B2 7/2014 Bergkvist
8,833,854 B2 9/2014 Lu et al.
D722,779 S 2/2015 Gov
8,960,787 B2 2/2015 Warncke et al.
8,967,710 B2 3/2015 Hu et al.
9,033,417 B2 5/2015 Mo
9,101,225 B2 8/2015 Kostyniak et al.
9,127,709 B2 9/2015 Shan
9,161,636 B2 10/2015 Opsvik et al.
D746,071 S 12/2015 Haley
9,200,746 B2 12/2015 Xiao
9,254,048 B2 2/2016 Chen
9,339,118 B2 5/2016 Gubitosi et al.
D764,818 S 8/2016 Nassif
9,420,899 B2 8/2016 Merlo
9,439,517 B2 9/2016 Cheng
9,480,343 B2 11/2016 Haut et al.
9,554,657 B2 1/2017 Taylor et al.
9,554,658 B2 1/2017 Horst et al.
9,603,464 B2 3/2017 Sclare et al.
9,635,955 B2 5/2017 Greger
2001/0035112 A1 * 11/2001 Guard ..... A47D 1/008 108/25
2002/0036416 A1 * 3/2002 Mendenhall ..... A47D 1/008 297/148
2003/0067198 A1 * 4/2003 Treen ..... A47D 1/002 297/250.1
2003/0197403 A1 * 10/2003 Greger ..... A47D 1/008 297/148
2003/0218366 A1 * 11/2003 Rho ..... A47D 1/002 297/153
2004/0026976 A1 2/2004 Chen et al.
2005/0017549 A1 * 1/2005 Chen ..... A47D 1/02 297/16.1
2005/0242632 A1 * 11/2005 Asbach ..... A47D 1/004 297/148
2005/0248192 A1 * 11/2005 Schaller ..... A47C 3/34 297/239
2006/0138827 A1 6/2006 Kassai et al.
2006/0220349 A1 * 10/2006 Wolf ..... A47D 1/02 280/650
2007/0024095 A1 * 2/2007 Chen ..... A47D 1/002 297/16.1
2007/0029845 A1 * 2/2007 Riedl ..... A47D 1/002 297/16.1
2007/0069566 A1 3/2007 Li
2007/0145790 A1 6/2007 Ventrola
2007/0290528 A1 * 12/2007 Chen ..... A47D 1/02 297/41
2008/0122270 A1 * 5/2008 Dubiel ..... A47D 1/008 297/173
2008/0179921 A1 7/2008 Lake et al.
2008/0203779 A1 8/2008 Cheng
2008/0217983 A1 9/2008 Cheng
2008/0290699 A1 * 11/2008 Golias ..... A47D 1/002 297/16.1
2009/0001776 A1 * 1/2009 Bearup ..... A47D 1/002 297/153
2009/0029845 A1 1/2009 Guillou et al.
2009/0039692 A1 * 2/2009 Tuckey ..... A47D 1/004 297/344.22
2009/0206639 A1 * 8/2009 Bearup ..... A47D 1/002 297/151
2009/0315374 A1 * 12/2009 Hu ..... A47D 1/004 297/256.16
2010/0264719 A1 10/2010 Burns et al.
2011/0074187 A1 * 3/2011 Zhong ..... A47D 1/006 297/130
2012/0025569 A1 * 2/2012 Bergkvist ..... A47D 1/008 297/174 R
2012/0026000 A1 * 2/2012 Chen ..... A47D 1/106 340/687
2012/0286545 A1 11/2012 Cheng
2013/0214103 A1 8/2013 Wu et al.
2013/0241248 A1 * 9/2013 Kostyniak ..... A47D 1/00 297/130
2013/0292984 A1 11/2013 You et al.
2014/0054936 A1 * 2/2014 Varney ..... A47D 1/008 297/149
2014/0077534 A1 * 3/2014 Stolarz ..... A47D 1/008 297/174 R
2014/0208987 A1 * 7/2014 Varney ..... A47D 1/008 108/28
2014/0265487 A1 * 9/2014 Michelson ..... A47D 1/004 297/256.11
2014/0368006 A1 * 12/2014 Taylor ..... A47D 1/004 297/188.11
2014/0368014 A1 * 12/2014 Haut ..... A47D 1/008 297/344.12
2015/0108123 A1 * 4/2015 Linehan ..... A47D 3/00 220/17.1
2015/0157140 A1 6/2015 Yang
2015/0289674 A1 10/2015 Winterhalter
2015/0335170 A1 11/2015 Castilla
2015/0359354 A1 * 12/2015 Greger ..... A47D 1/004 297/134
2015/0366371 A1 12/2015 Kostyniak et al.
2016/0007766 A1 1/2016 Sack et al.
2016/0174727 A1 * 6/2016 Haut ..... A47D 11/002 297/130
2016/0192787 A1 7/2016 Perrin et al.
2016/0242565 A1 8/2016 Van den Akker
2016/0309910 A1 * 10/2016 Sclare ..... A47D 7/01
2016/0324330 A1 11/2016 Xu
2016/0331152 A1 * 11/2016 Wells ..... A47D 15/00
2016/0338517 A1 11/2016 Snowden
2016/0367044 A1 12/2016 Horst et al.
2017/0112294 A1 4/2017 Taylor et al.
2017/0251826 A1 * 9/2017 Sclare ..... A47D 1/004

(56) References Cited

U.S. PATENT DOCUMENTS

FOREIGN PATENT DOCUMENTS

| | | | | | |
|---|---|---|---|---|---|
| EP | 2008550 | A1 | | 12/2008 | |
| EP | 2305076 | A1 | | 4/2011 | |
| EP | 2671471 | A1 | * | 12/2013 | ..... A47D 1/02 |
| WO | 2009158134 | A1 | | 12/2009 | |

* cited by examiner

CONVERTIBLE HIGH CHAIR

CROSS-REFERENCE TO RELATED APPLICATIONS

This application is a continuation-in-part of U.S. Non-Provisional Patent Application Ser. No. 15/137,335, filed Apr. 25, 2016, which claims the benefit of U.S. Provisional Patent Application Ser. No. 62/152,845 filed Apr. 25, 2015 and U.S. Provisional Patent Application Ser. No. 62/215,943 filed Sep. 9, 2015, the entireties of which are hereby incorporated herein by reference for all purposes. This application also claims the benefit of U.S. Provisional Patent Application Ser. No. 62/304,653 filed Mar. 7, 2016 and U.S. Provisional Patent Application Ser. No. 62/394,958 filed Sep. 15, 2016, the entireties of which are hereby incorporated herein by reference for all purposes.

TECHNICAL FIELD

The present invention relates generally to the field of child support devices, and more particularly to child high chairs.

BACKGROUND

Conventional children's high chairs typically include a child seat elevated above a floor by a frame. Certain high chairs, however, are provided with an additional seat that can be removably secured to the high chair's child seat in order to convert the high chair for use by children of different ages. In some previously known devices, when the booster seat is detached from the high chair, it is typically coupled to a separate base member and can then be secured to a standard high chair for use as a booster.

Accordingly, it can be seen that needs exist for an improved convertible high chair that is easier and more convenient for users to convert and that includes a removable booster seat capable of stably supporting itself on a support surface (e.g. a standard chair) without the need to be secured to a separate component (e.g. a separate base member).

It is to the provision of a children's high chair meeting these and other needs that the present invention is primarily directed.

SUMMARY

In example embodiments, the present invention provides a convertible children's high chair providing improved functionality and convenience for parents and other adult caregivers. According to various embodiments, the convertible high chair generally includes a first child seat supported above a floor by a high chair frame, and a second child seat configured to be removably coupled to the first child seat. The second child seat is configured such that, when detached from the high chair's first child seat, it can be used independently as a booster seat. In certain embodiments, the second child seat includes a base surface configured to stably support the second child seat on a separate support surface.

In one aspect, the present invention relates to a convertible children's high chair including a frame configured to rest on a support surface, a first child seat defining a first seating surface and a second child seat defining a second seating surface. The first child seat is repositionably coupled to the frame and supported above the support surface. The second child seat is configured to be removably attached to the first child seat and includes a base configured to rest on a flat support surface to support the second child seat when the second child seat is decoupled from the first child seat.

In another aspect, the present invention relates to a convertible high chair including a frame configured to rest on the floor, a first child seat defining a first seating portion and a second child seat defining a second seating portion. The first child seat is coupled to the frame and supported above the floor and the second child seat is configured to be removably coupled to the first child seat. The second child seat includes a base with a downward extending skirt. The skirt is configured to extend substantially around the entirety of the first seating portion of the first child seat when the second child seat is coupled to the first child seat.

In still another aspect, the present invention relates to a convertible high chair including a frame configured to rest on the floor, a first child seat defining a first seating surface, a second child seat defining a second seating surface and a tray assembly. The first child seat is coupled to the frame and supported above the floor and the second child seat is configured to be removably coupled to the first child seat. The tray assembly includes a base tray pivotally coupled to the second child seat and a detachable tray removably coupled to the base tray.

In still another aspect, the present invention relates to a tray assembly for a children's high chair including a base tray, a detachable tray removably coupled to the base tray, and an auxiliary tray extensible and retractable relative to the detachable tray.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Various embodiments of the present invention are directed to a convertible children's high chair. According to various embodiments, the convertible high chair generally comprises a first child seat supported above a floor by a high chair frame, and a second child seat configured for being removably coupled to the first child seat. The second child seat is configured such that, when detached from the high chair's first child seat, it can be used apart from the high chair as a booster seat (e.g., secured to the seating surface of a standard chair or another support surface) in a different mode of use independent of the frame. In certain embodiments, the convertible high chair is convertible for use by children of varying ages. For example, when the second child seat is coupled to the first child seat, the high chair functions in a first configuration as an infant high chair. In a second configuration, when the second child seat is detached, the high chair functions as a toddler booster seat. In a third configuration, the second child seat can also include a base surface configured to stably support the second child seat on a separate support surface (e.g., without the need to be attached to or mounted to a separate base or support member). In the third configuration, the second child seat functions on its own as an infant or toddler booster seat.

Figure 2:
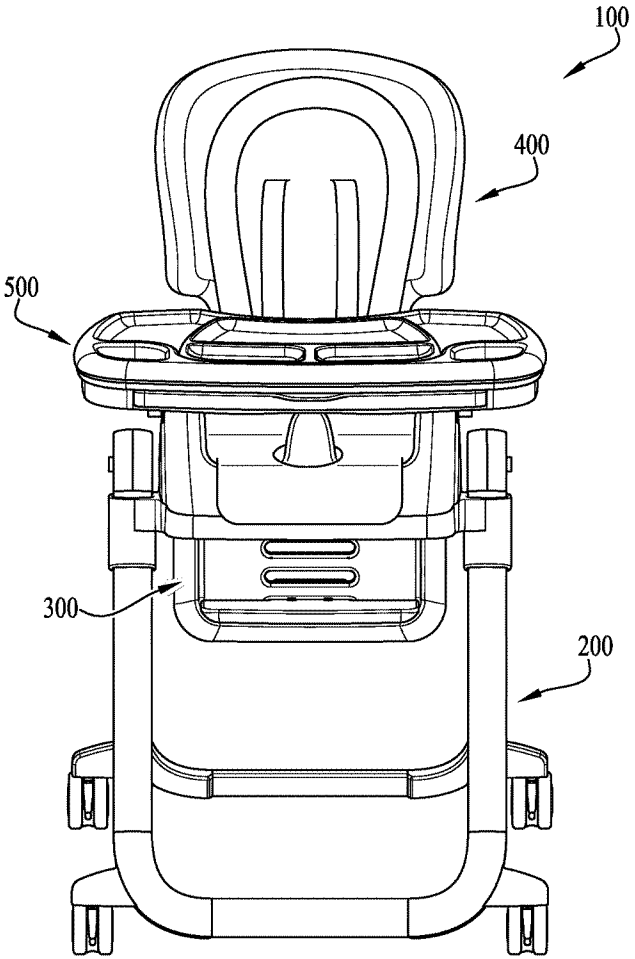
FIG. 2 shows a front view of the convertible high chair of FIG. 1.
Figure 1:
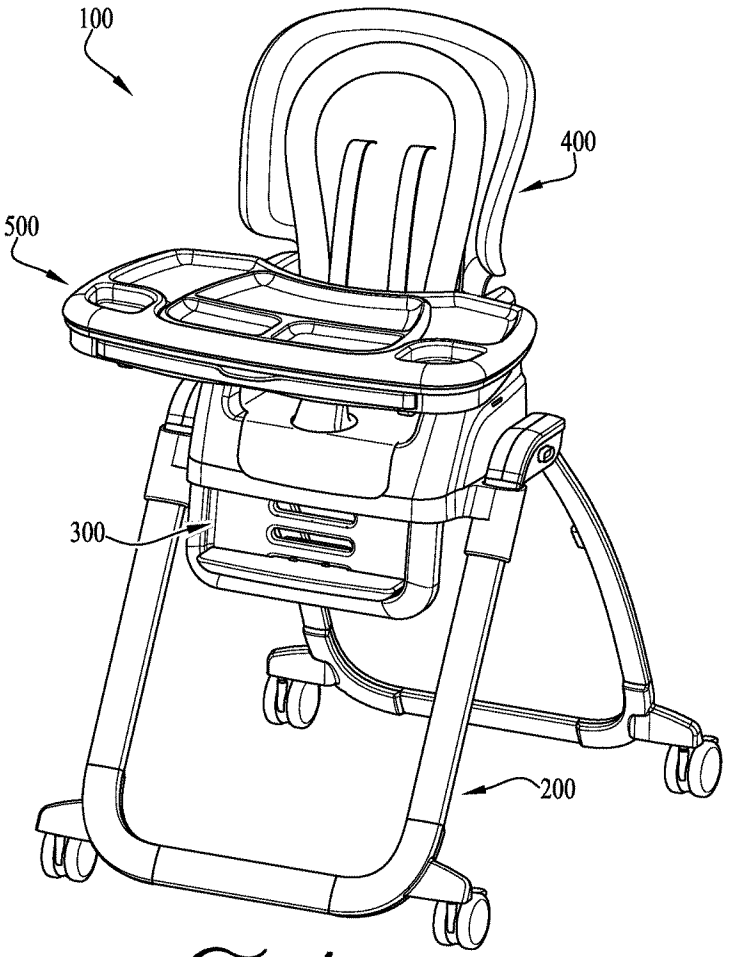
FIG. 1 is a perspective view of a convertible high chair in a first configuration according to an example embodiment of the invention.
Figure 3:
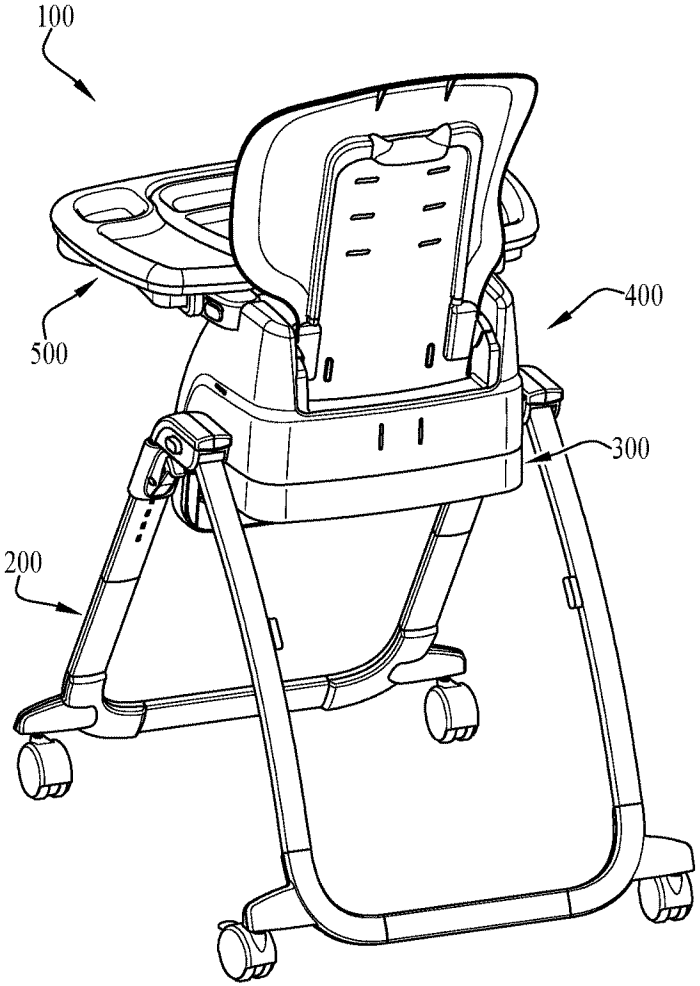
FIG. 3 shows a back view of the convertible high chair of FIG. 1.

With reference now to the drawing figures, wherein like reference numbers represent corresponding parts throughout the several views, FIGS. 1-49 show a convertible high chair 100 according to an example embodiment of the present invention. The high chair 100 generally includes a frame 200, a first child seat 300 and a second child seat 400 that includes a tray assembly 500. FIGS. 1-3 illustrate the convertible high chair 100 in a first configuration or mode of use as an infant high chair, in which the second child seat 400 is coupled to the first child seat 300 and thereby supported by the frame 200 in a high chair configuration.

Figure 4:
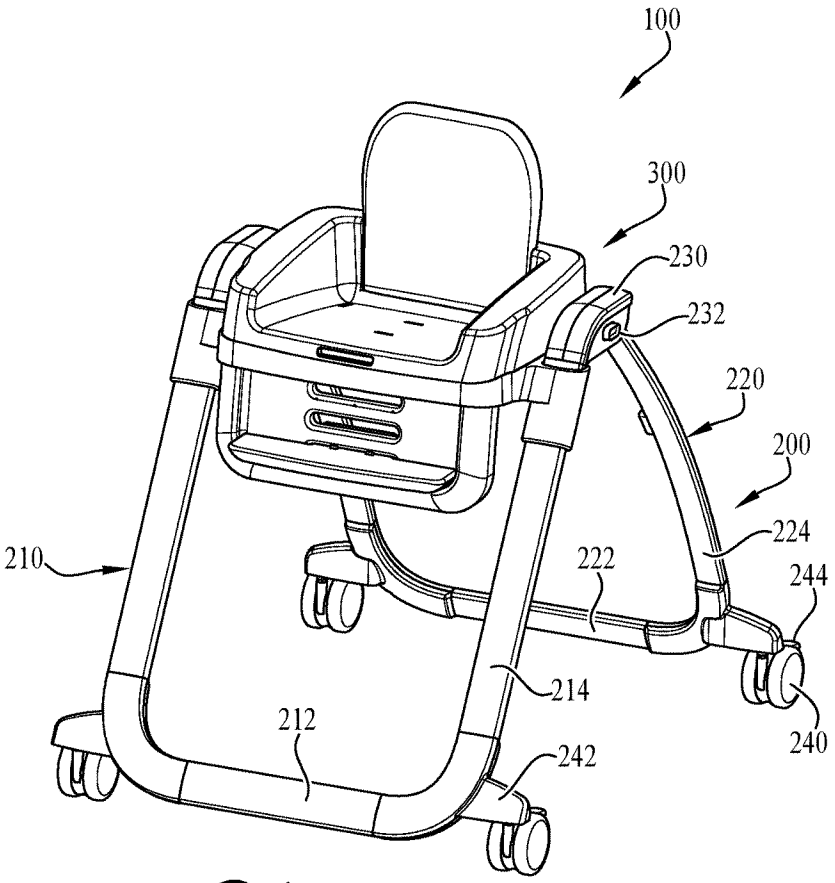
FIG. 4 is a perspective view of a convertible high chair in a second configuration according to an example embodiment of the invention.

FIG. 4 illustrates the second configuration in which the convertible high chair 100 is adapted for a second mode of use as a stand-alone toddler booster seat. In this configuration, the second child seat 400 is decoupled from the first child seat 300 and is removed from the high chair 100 to expose the seat portion 310 of the first child seat. The first child seat 300 is supported a distance above the floor by the frame 200.

Figure 6:
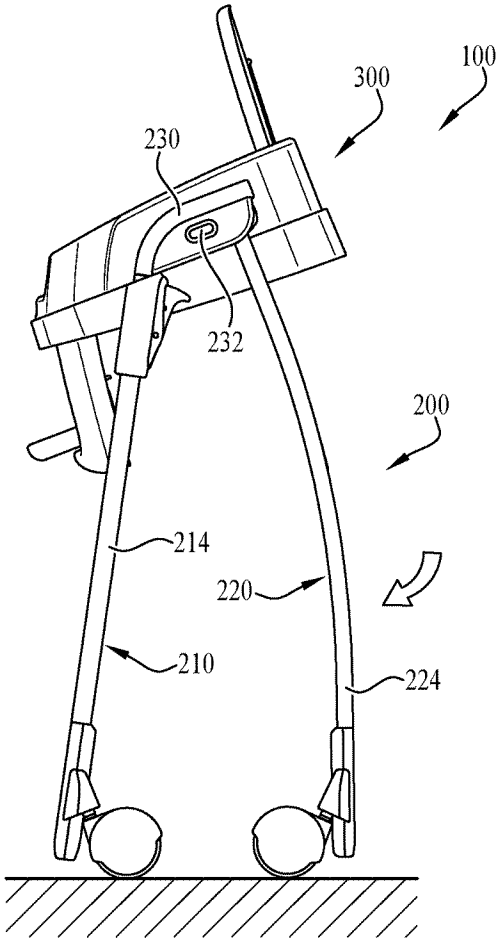
FIG. 6 shows a side view of the convertible high chair of FIG. 4 in a folded position.
Figure 5:
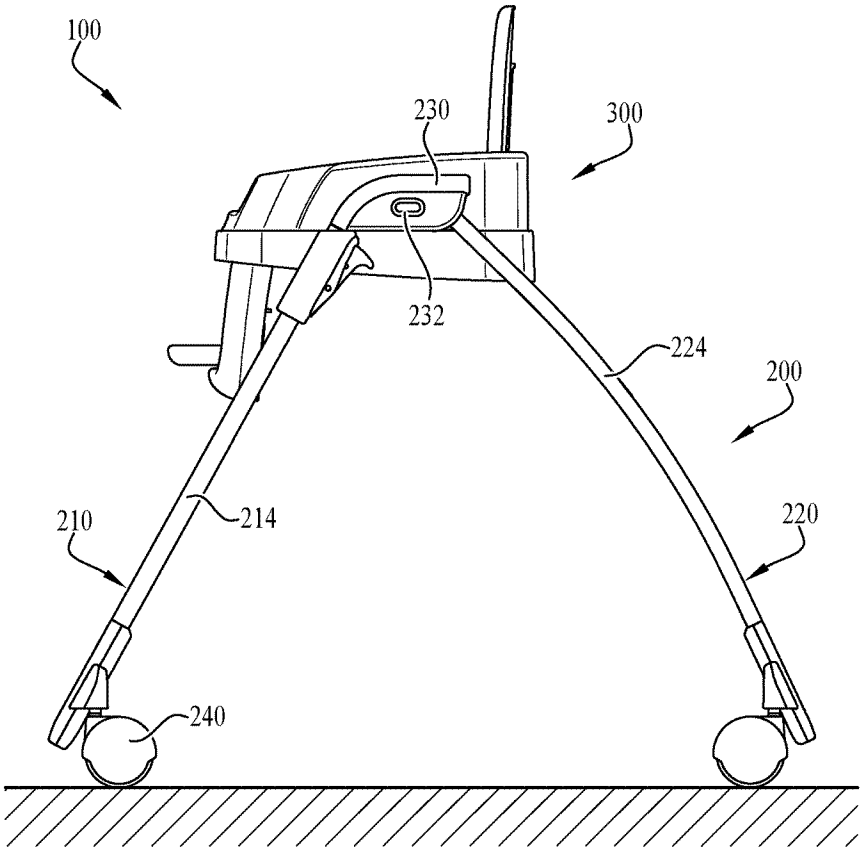
FIG. 5 shows a side view of the convertible high chair of FIG. 4.
Figure 7:
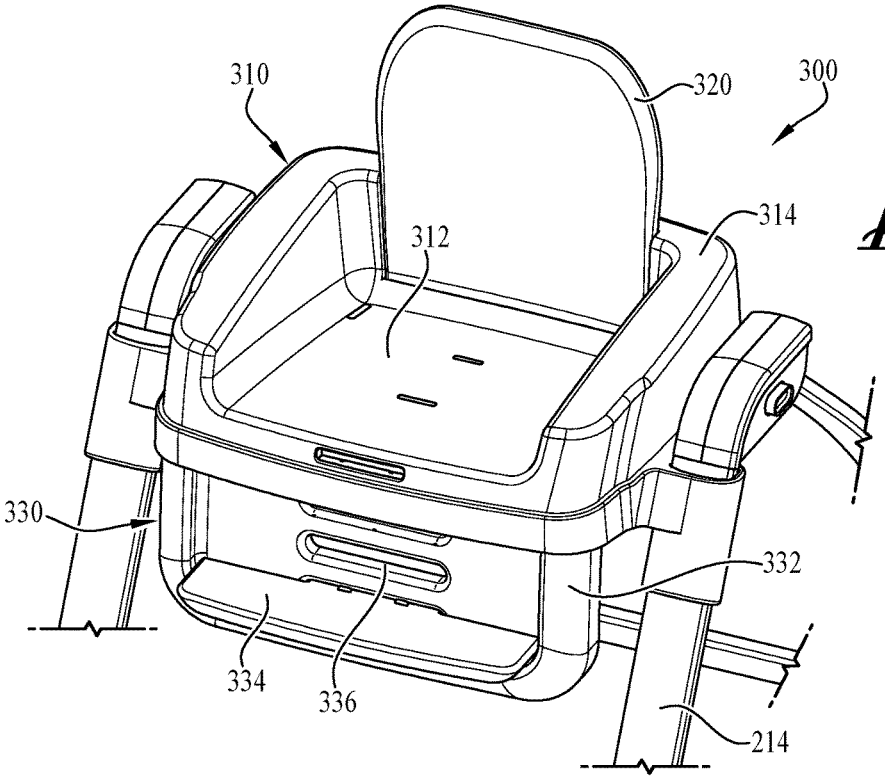
FIG. 7 shows a detailed view of the first child seat of the convertible high chair of FIG. 4.
Figure 8:
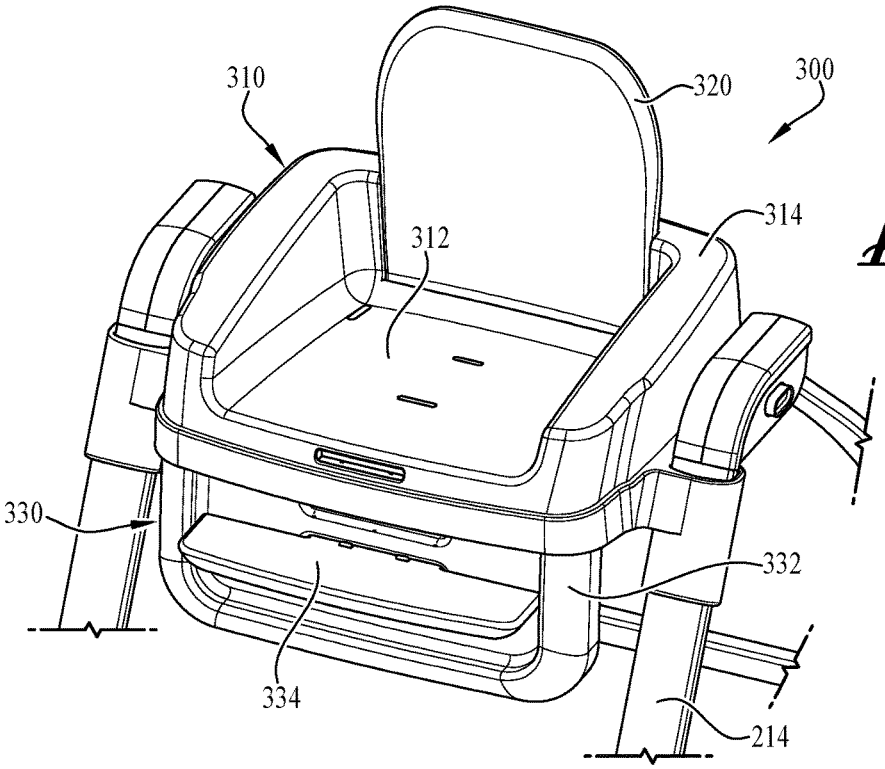
FIG. 8 shows a detailed view of the first child seat of the convertible high chair of FIG. 4.
Figure 9:
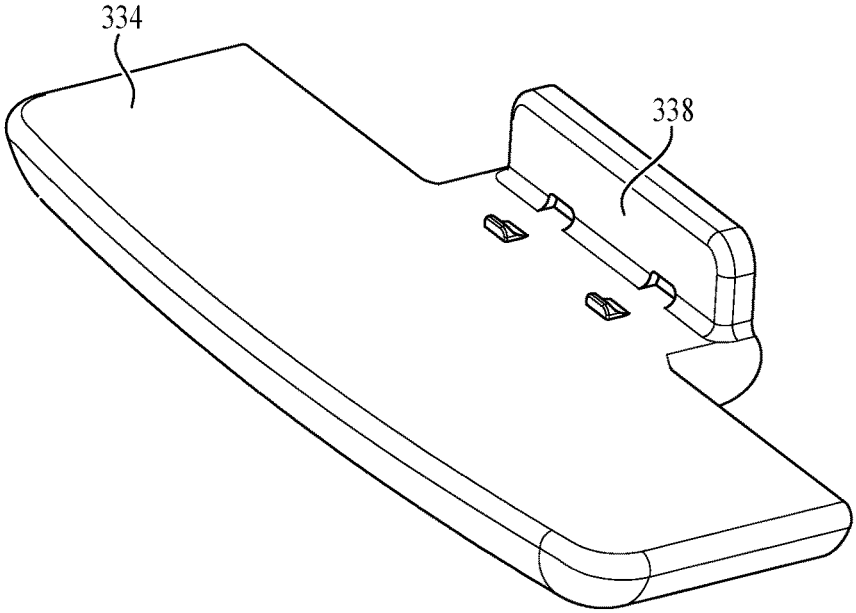
FIG. 9 is a perspective view of a foot rest ledge of a children's high chair according to an example embodiment of the invention.
Figure 10:
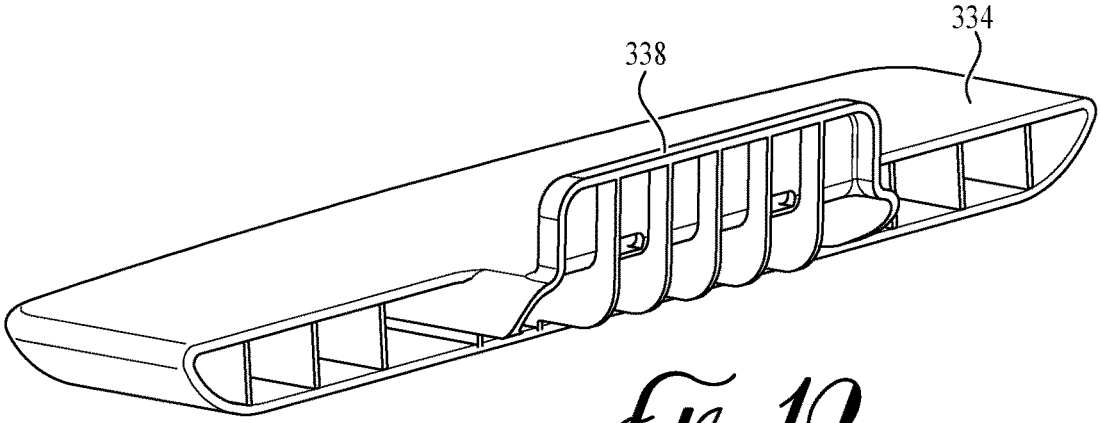
FIG. 10 shows a back view of the foot rest ledge of FIG. 9.

The frame 200, shown in FIGS. 4-6, is generally configured for resting on a floor or other support surface. The frame 200 generally includes a front U-shaped frame member 210 and a back U-shaped frame member 220 connected at a hubs 230 positioned on either side of the frame. The frame members 210, 220 each include a cross frame member 212, 222 and generally upright frame members or legs 214, 224 angled in the form of an A-frame support structure. The cross frame members 212, 222 extend generally parallel with the support surface or floor. The upright frame members 214, 224 extend at an upward angle from the cross frame members 212, 222 to the hub 230. In the depicted embodiment, the front upright frame members 214 are attached to the hubs 230 in a fixed position, whereas the back upright frame members 224 are pivotally attached to the hubs. This pivotal attachment allows a user to fold the frame 200 from an expanded in-use position, shown in FIG. 5, to a more compact storage position, shown in FIG. 6. The hubs 230 can each include a locking mechanism that locks the frame in the in-use and/or storage position. In the example embodiment, the locking mechanism locks the back frame member 220 in both the in-use and folded position. The hubs 230 each include a button 232 that, when pressed, unlocks the locking mechanism and allows the back frame member 220 to pivot between the in-use and folded position. In example embodiments, two-handed operation by an adult is utilized to fold the mechanism, to prevent inadvertent release. In alternate embodiments, another release mechanism, such as a handle or switch, can be used. In alternate embodiments, the front frame member 210 or both frame members are able to pivot. In the depicted embodiment, the frame 200 also includes a plurality of wheels 240 (e.g., castors) that permit the frame 200 to be rolled by a user along the floor. In example embodiments, the wheels 240 have a diameter of at least about 1.5 inches to help the frame roll along a thick carpet. The wheels 240 optionally include caster mechanisms for rotation and turning. In alternate embodiments, larger or smaller wheel diameters can be used. In the depicted embodiment, wheel attachment protrusions 242 attach the wheels 240 to the frame members 210, 220. The protrusions 242 position the wheels 240 a distance outwardly away from the frame members 210, 220 for improved stability. In alternate embodiments, the wheels 240 attach directly to the frame members 210, 220. The wheels 240 can include a lock and release or braking mechanism 244 for selectively locking the wheels to prevent rolling or releasing the wheels to allow rolling. In alternate embodiments, the frame 200 can include other sliding or rolling means.

Figure 51:
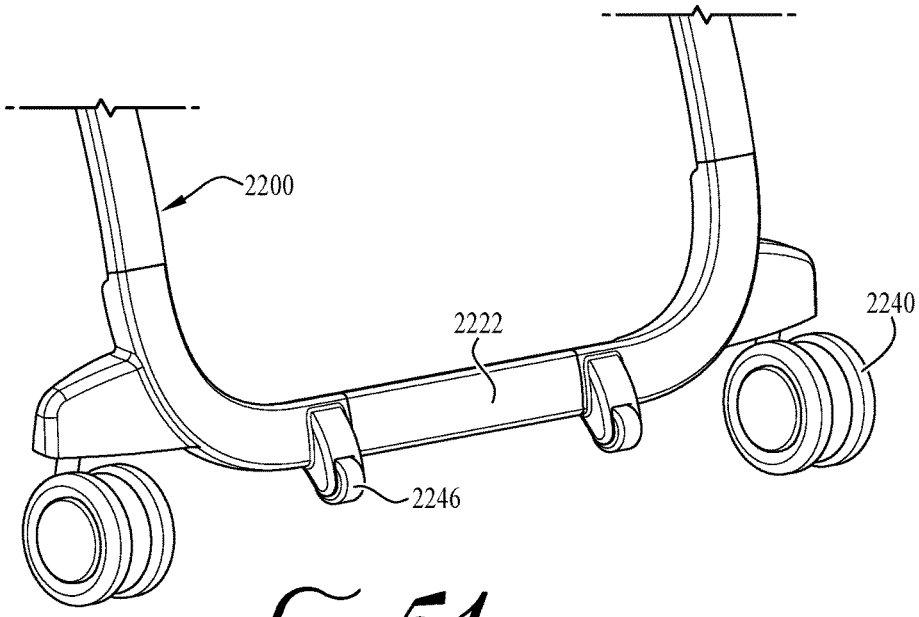
FIG. 51 is a detailed perspective view of a frame of a convertible high chair according to another example embodiment of the invention.
Figure 52:
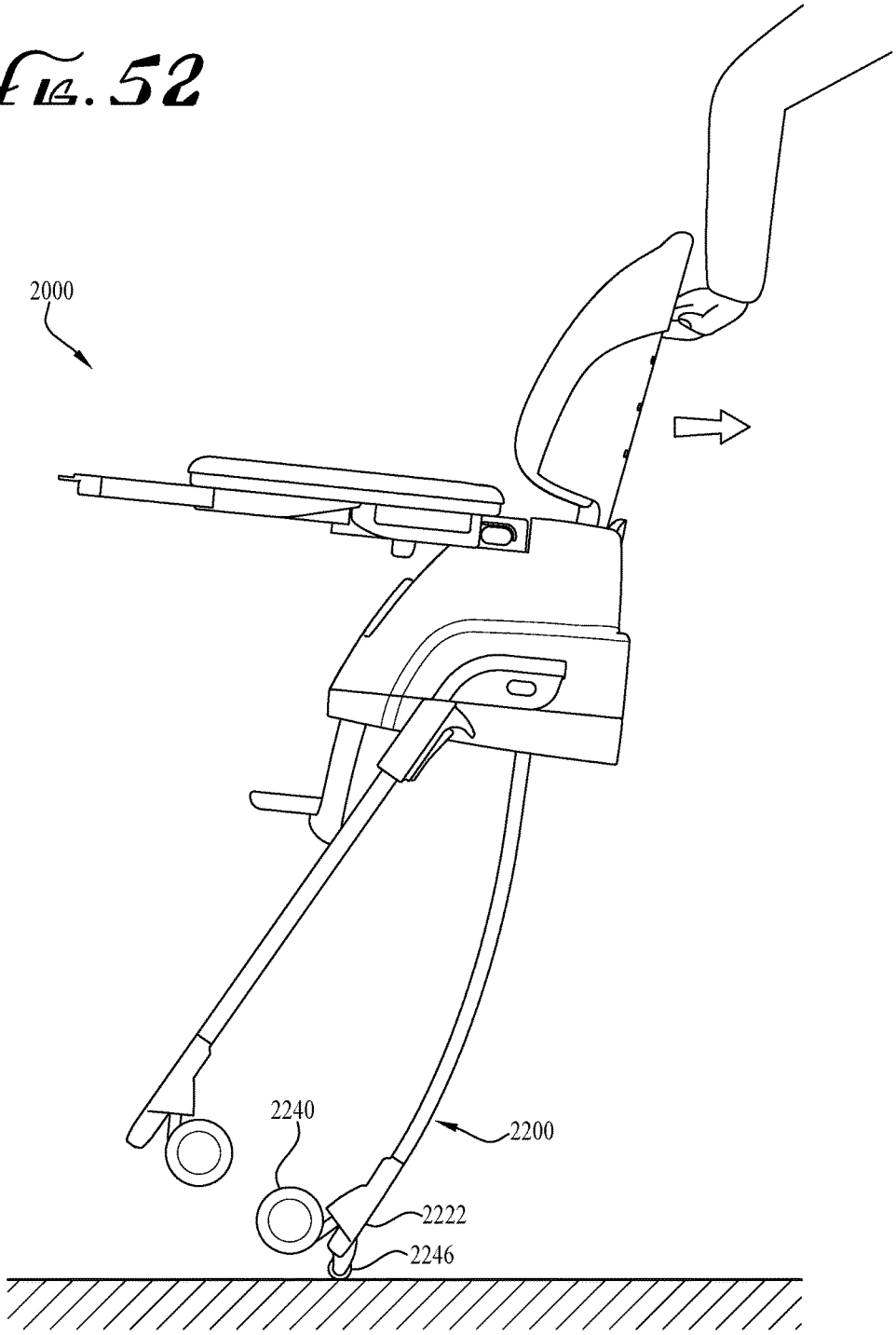
FIG. 52 is a perspective view of the convertible high chair of FIG. 51 in a folded position.

In example embodiments, the frame 2200 of the high chair 2000 can also include additional rolling elements 2246, as shown in FIGS. 51 and 52. In the depicted embodiment, the back cross frame member 2222 can include one or more rollers positioned in between the wheels 2240. The rollers 2246 are configured to not engage the support surface when the frame 2200 is in the unfolded use position, as shown in FIG. 51. In example embodiments, the rollers 2246 have a smaller diameter than the wheels 2240. The rollers 2246 are configured to engage the support surface when the frame 2200 is pulled by a caregiver in the folded position, as shown in FIG. 52. The rollers 2246 help the caregiver move the high chair 2000 in this folded, angled position.

The first child seat 300, shown in FIGS. 7-15, is attached to the front vertical frame members 214 of the frame 200 and supported a distance above the support surface. The first child seat 300 generally includes a seat portion 310, a backrest 320 and optionally a footrest 330. In the depicted embodiment, the seat portion 310 includes a seating surface 312 and shoulders or armrests 314. The seating surface 312 provides a surface substantially parallel to the floor or support surface configured to support a child seated thereon. The shoulders 314 extend upwardly from lateral sides and back of the seating surface 312. The shoulders 314 can act as armrest for a child seated therein. The backrest 320 extends upward from the seating surface 312 to provide back support to a child seated thereon. In the example embodiment, the back rest 320 is pivotally attached to the seating surface 312 and is able to be moved between an in-use position, shown in FIG. 7, and a folded position, discussed further below. In alternate embodiments, the back rest 320 is detachable from the first child seat 300 or fixed in position. In the depicted embodiment, the first child seat 300 is generally dimensioned to accommodate a toddler-age child. As such, the convertible high chair 100 is well suited to function as a stand-alone toddler high chair or booster in the second configuration. However, as will be appreciated from the description herein, various other embodiments of the first child seat 300 can be dimensioned for supporting children of any age.

Figure 50:
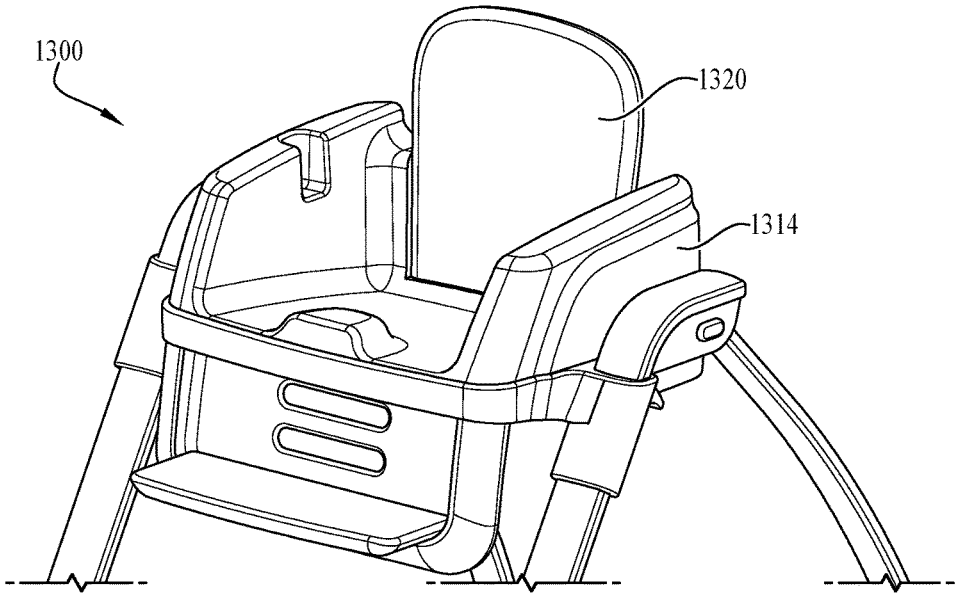
FIG. 50 is a perspective view of a first child seat of a convertible high chair according to another example embodiment of the invention.

In example embodiments of the first child seat 1300, the shoulders 1314 are dimensioned to comply with applicable safety standards, as shown in FIG. 50. For example, the European Committee for Standardization's requirements for Children's High Chairs includes minimum dimensions for lateral protections. In example embodiments, the shoulders 1314 are configured such that the distance between the top of the shoulder and the bottom of the back rest 1320 is at least about 145 mm. The distance between the top of the shoulder 1314 and the bottom of the back rest 1320 can also be at least about 150 mm. In other embodiments, the distance between the top of the shoulder 1314 and the bottom of the back rest 1320 can be smaller than 145 mm or larger than 150 mm.

Figure 11:
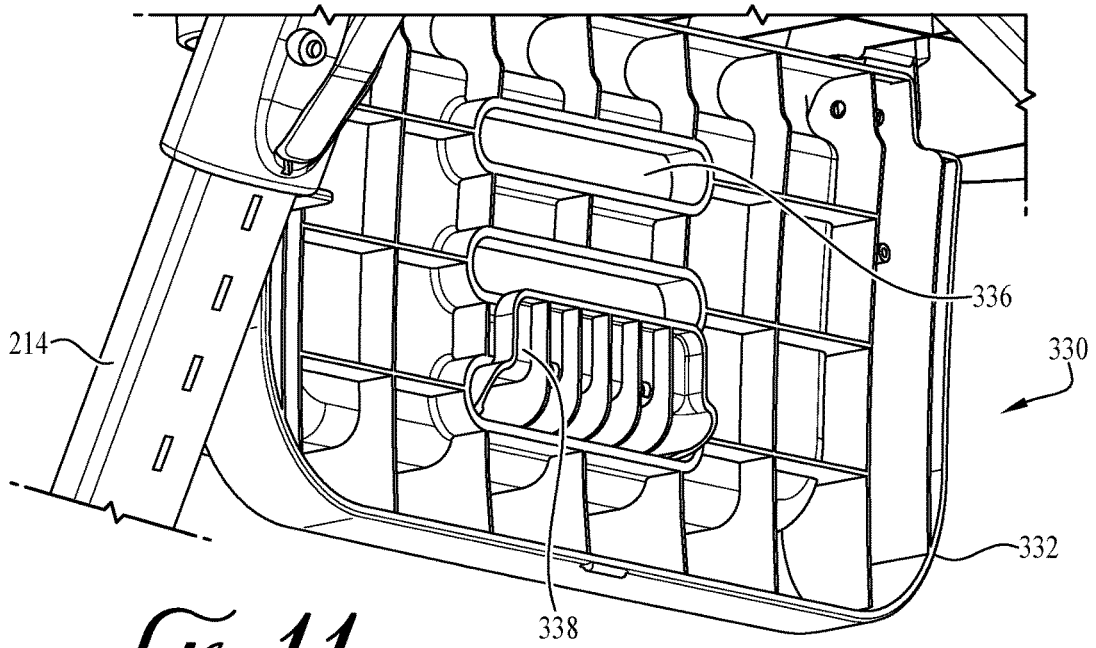
FIG. 11 is a detailed view of the back of the foot rest of the convertible high chair of FIG. 4.
Figure 12:
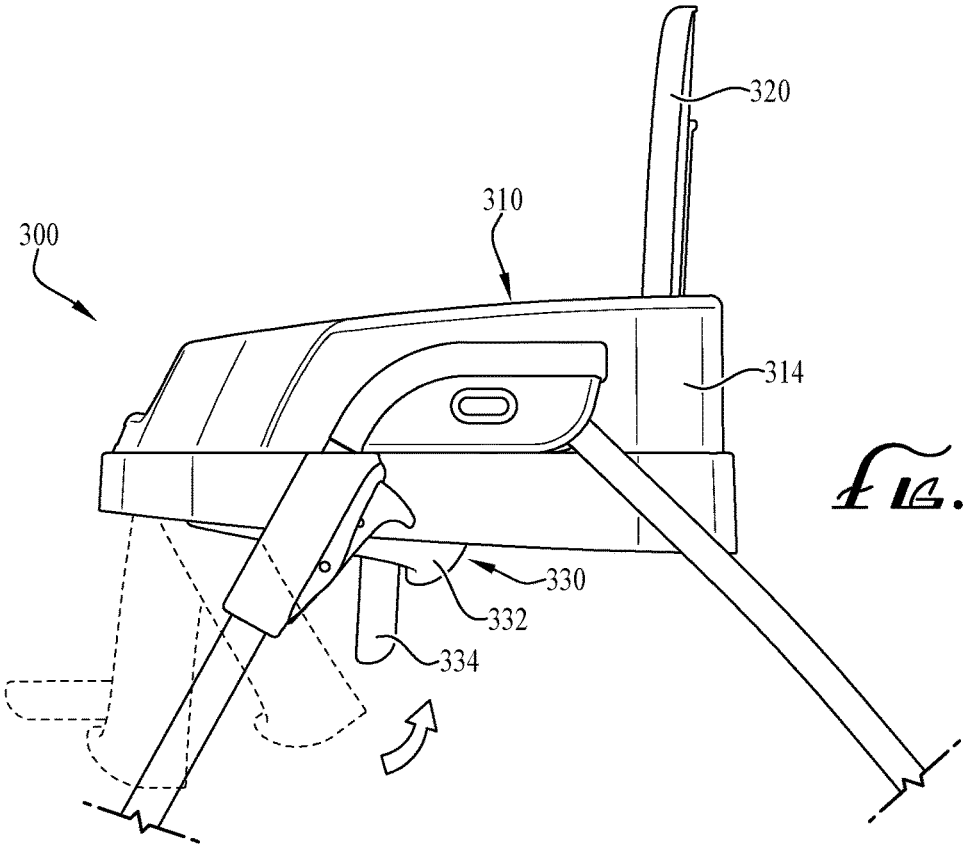
FIG. 12 shows a side view of the foot rest of the convertible high chair of FIG. 4.

The footrest 330, shown in detail in FIGS. 8-12, includes a footrest base 332 and a ledge 334. The foot rest base 332 is formed from a panel that, in the in-use position shown in FIG. 7, extends downward from the substantially front edge of the bottom of the seat portion 310 of the first child seat 300. In the in-use position, the footrest base 332 is positioned substantially perpendicular to the seating surface 312. The ledge 334 is removably attached to the footrest base 332 such that the flat surface of the ledge is substantially perpendicular to the foot rest base 332. The ledge 334 is configured to, in the in-use position, provide a surface to support the feet of a child seated in the first child seat 300. The footrest ledge 334 can be positioned on the footrest base 332 at a variety of distances relative to the seating surface 312 to accommodate different leg lengths of the child seated therein. In the depicted embodiment, the footrest base 332 includes a plurality of receiving slots 336 and the ledge 334 includes a tab 338 extending perpendicularly from the ledge surface. To removably attach the ledge 334 to the footrest base 332, the tab 338 of the ledge is inserted through a slot 336 in the foot rest base and positioned such that a flat portion of the tab abuts the back of the footrest base, as shown in FIG. 11. To adjust the distance of the ledge 334 relative to the seating surface 312, the ledge is attached to different slots 336 in the footrest base 332. In alternate embodiments, the footrest ledge 334 can be repositionably attached to the footrest base 332 using other attachment means. In the depicted embodiment, the footrest 330 is movable between the in-use position, shown in FIG. 7, and a folded position, shown in FIG. 12. The footrest base 332 is pivotally attached to the bottom of the seat portion 310, allowing the footrest 330 to be folded to a position underneath and parallel to the bottom of the seat portion, shown in FIG. 12. In alternate embodiments, the foot rest 330 removable from the first child seat 300. In other embodiments, the footrest is repositionably attached to the frame 200.

Figure 13:
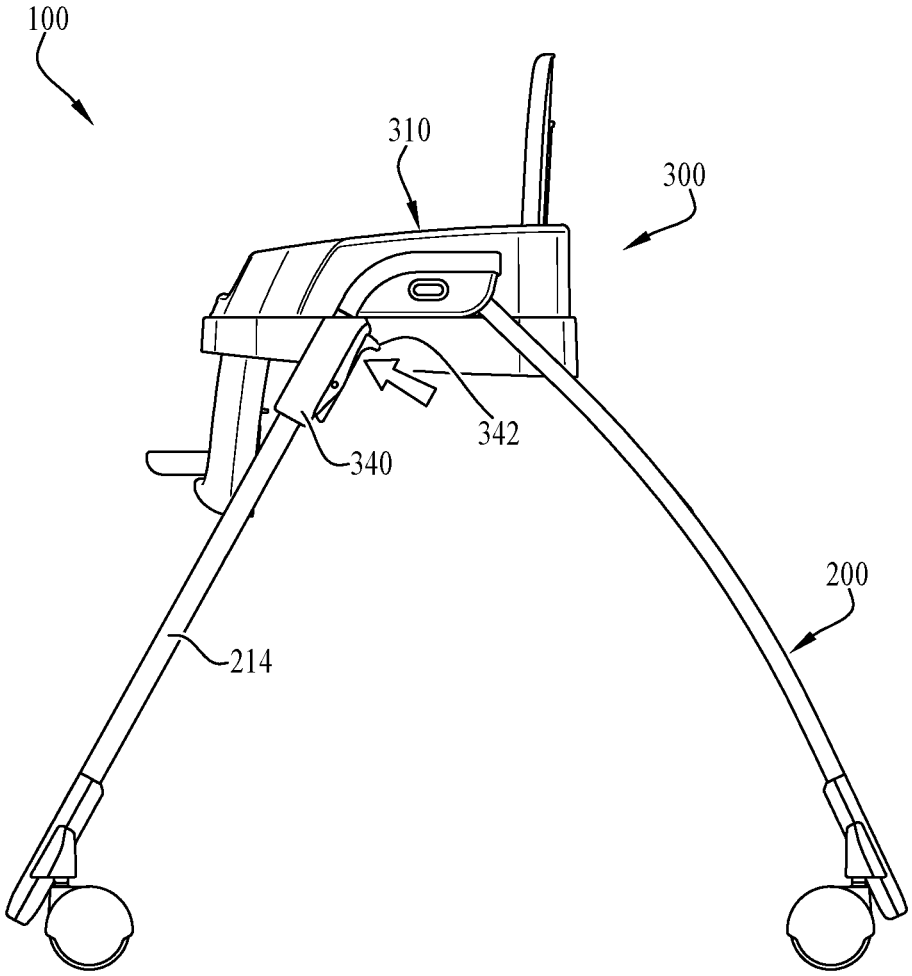
FIG. 13 shows a side view of the convertible high chair of FIG. 4.
Figure 14:
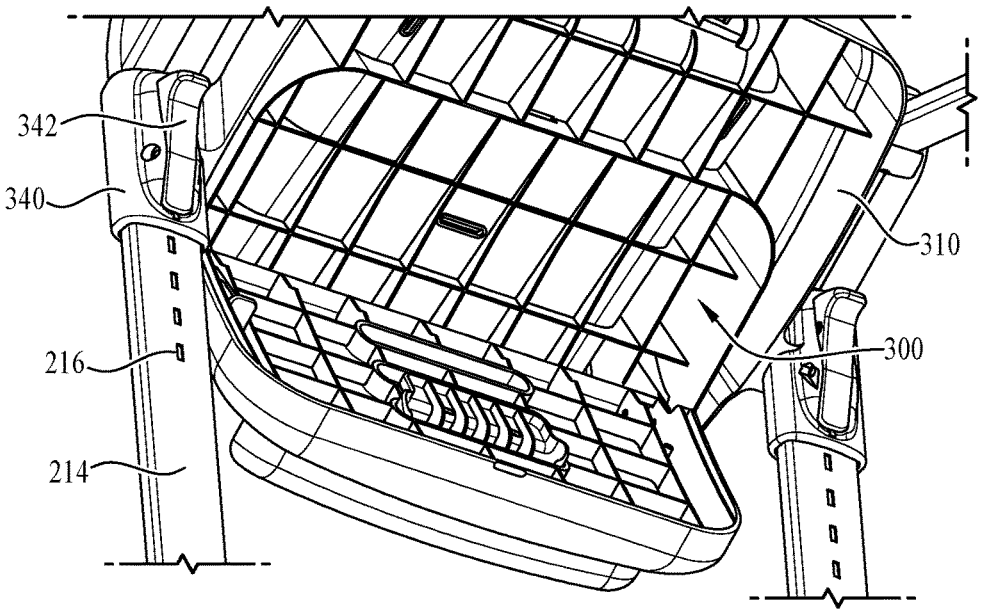
FIG. 14 shows a bottom view of the convertible high chair of FIG. 4.
Figure 15:
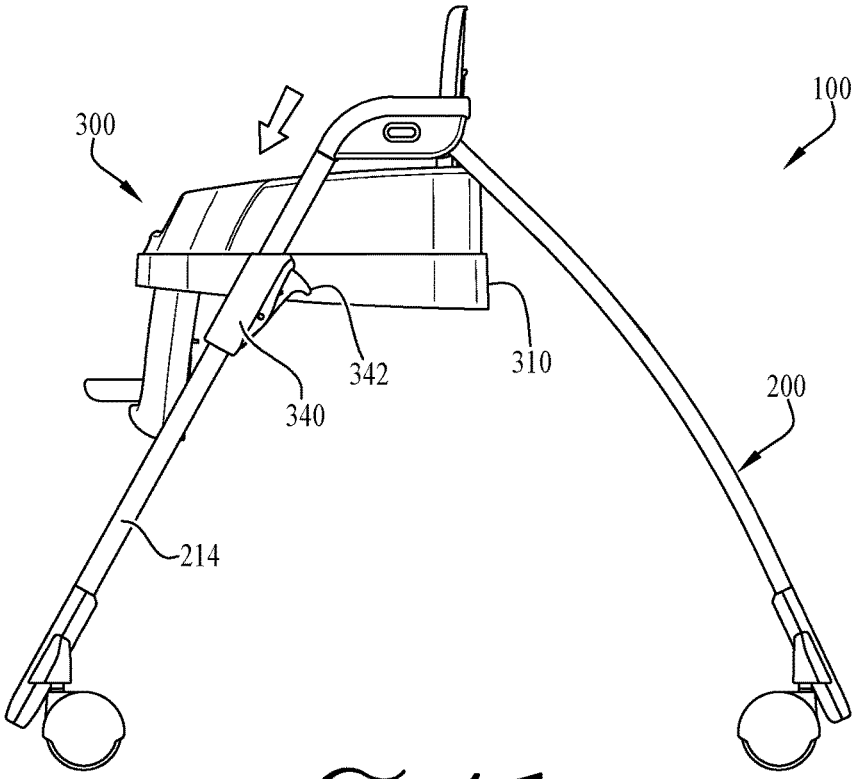
FIG. 15 shows a side view of the convertible high chair of FIG. 4.
Figure 16:
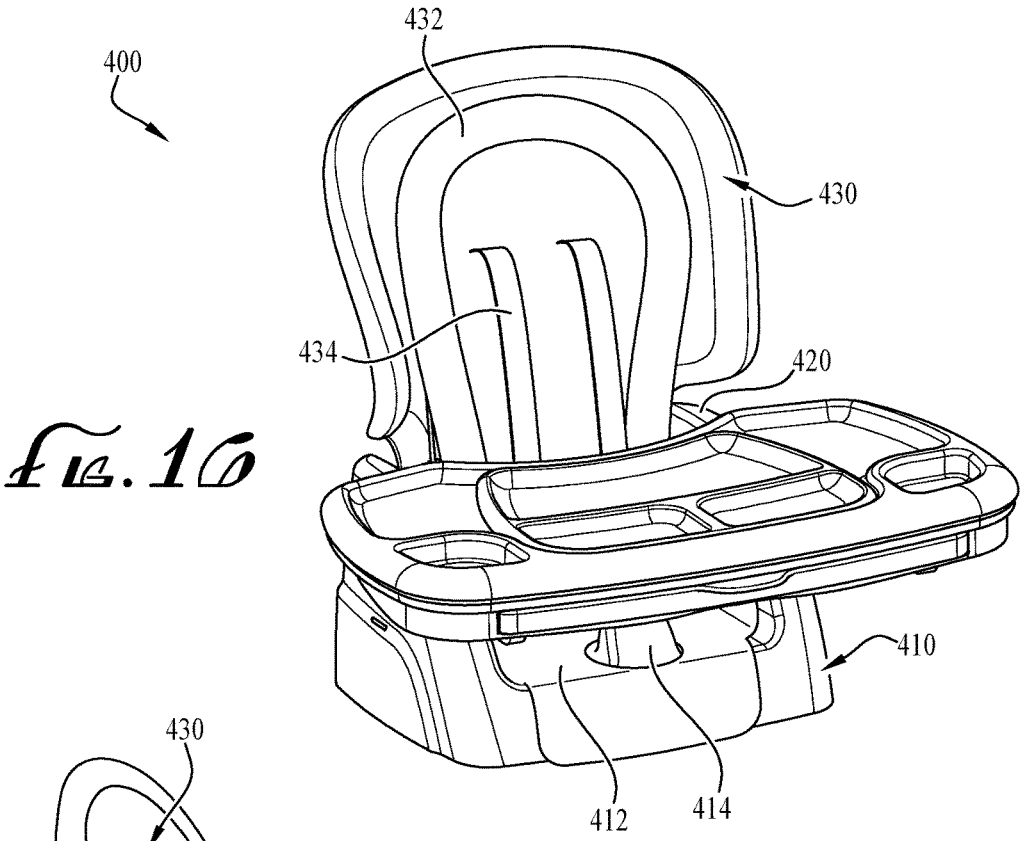
FIG. 16 is a perspective view of a second child seat of a convertible high chair according to an example embodiment of the invention.
Figure 17:
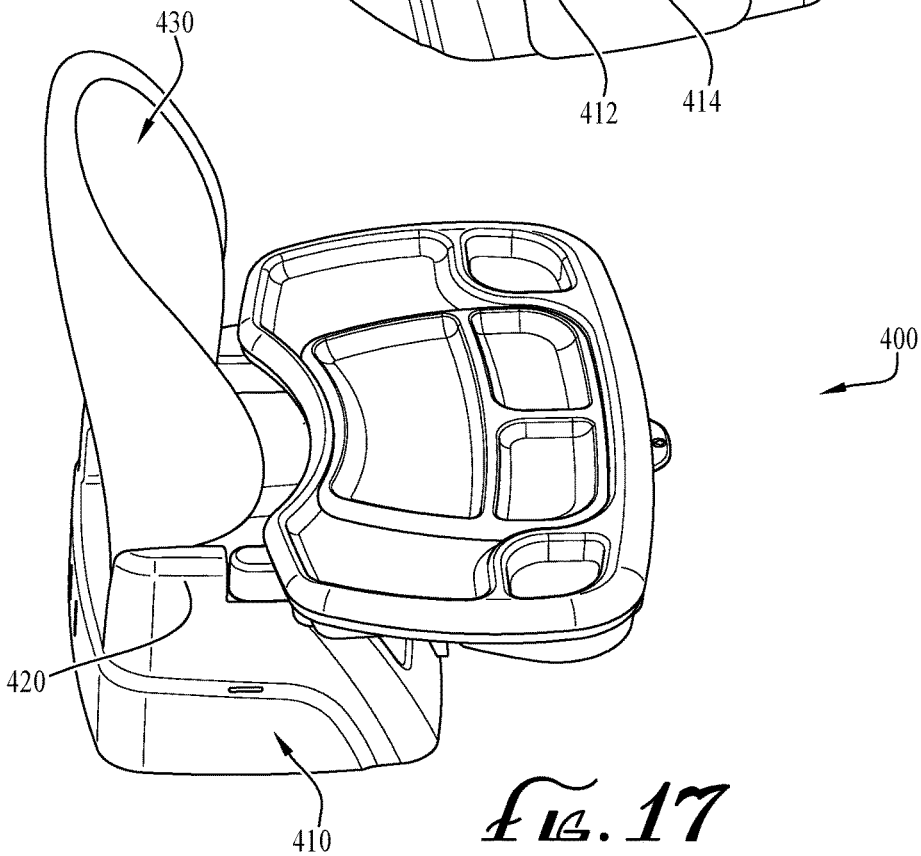
FIG. 17 shows a side view of the second child seat of FIG. 16.

The first child seat 300 is repositionably attached to the front upright frame members 214 of the frame 200 to provide height adjustment, as shown in FIGS. 13-15. In the depicted embodiment, the first child seat 300 includes attachment collars 340 positioned either side of the seat portion 310. The collars 340 are configured to surround and couple to the front upright frame members 214. This coupling is configured to be height adjustable in order to allow an adult caregiver to selectively raise and lower the first child seat 300. The attachment collars 340 each include a spring biased lever 342 with a first end configured to engage a series of notches or holes 216 on the back side of the front upright frame members 214, as shown in FIG. 14. The levers 342 are spring biased such that the first end remains engaged with the holes 216. To adjust the height of the first child seat 300, the adult caregiver can push the second end of the levers 342 to disengage the holes and the collars can be slid along the front vertical frame member 214 to the desired height. The first end of each lever 342 is released to reengage the holes 216 corresponding to the desired height. In the depicted embodiment, the second end of the lever 342 includes a hook portion configured to assist the caregiver when lifting or lowering the first child seat 300 to a different height. In alternate embodiments, alternate height adjustment mechanisms can be used. In alternate embodiments, the first child seat can be repositionably attached to the back upright frame members 224. In example embodiments, two-handed operation prevents inadvertent release and movement, and positioning the actuators away from access by a child seated in the seat prevents the child from accidentally releasing and moving the seat position.

Figure 53:
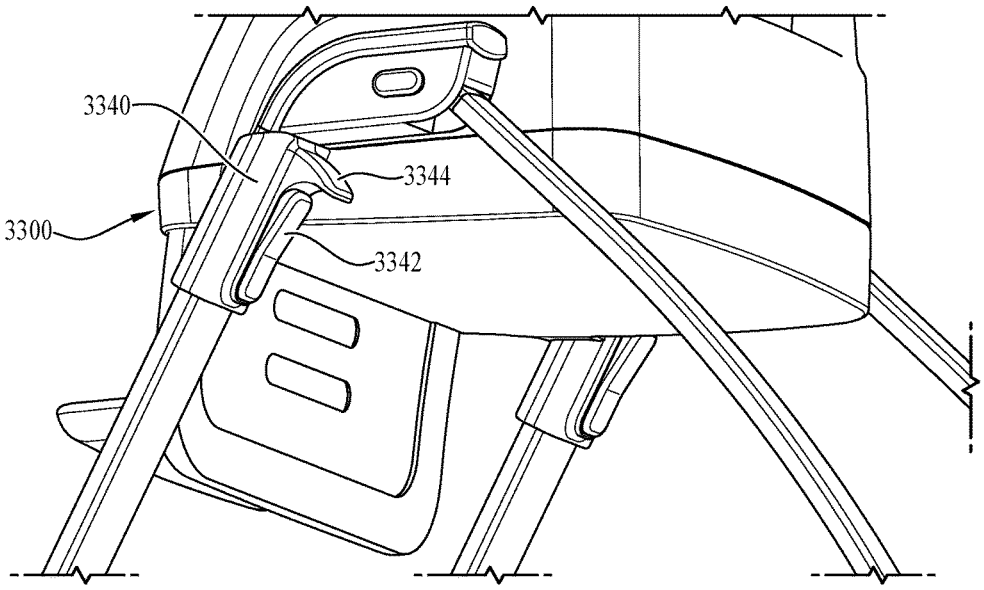
FIG. 53 is a detailed perspective view of a first child seat of a convertible high chair according to another example embodiment of the invention.

In other embodiments of the first child seat 3300, the attachment collars 3340 include a hook-shaped portion 3344 independent of the lever 3342, as shown in FIG. 53. The hook-shaped portion 3344 is generally positioned above the lever 3342. The hook-shaped portion 3344 is configured to assist the caregiver when lifting or lowering the first child seat 3300 to a different height. In this configuration, the caregiver can use the hook-shaped portion 3344 to support the weight of the first child seat 3300 independent of the pushing or releasing of the lever 3342.

In alternate embodiments of the high chair 5000, the first child seat 5300 is attached to the front upright frame member 5214 in a fixed position. In this embodiment, shown in FIG. 55, the front upright frame members 5214 can include a telescoping feature configured to adjust the height of the first child seat 5300. For example, the front upright frame members 5214 can include a base collar 5216 and an upper leg 5218. The upper leg 5218 is configured to slidingly engage with the base collar 5216. The position of the upper leg 5218 within the base collar 5216 can be adjusted to adjust the length of the upright frame member 5214 and thereby the height of the first child seat 5300. In alternate embodiments, both the front upright frame member 5214 and the back upright frame member 5224 include telescoping features.

The second child seat 400, shown in FIGS. 16-19, generally includes a base 410 and a seat back 430. The base 410 includes a seating surface 412 that provides a surface substantially parallel to the floor and is configured to support a child or infant seated thereon. In the depicted embodiment, the seating surface 412 includes an upwardly extending crotch restraint 414 configured to prevent a child from sliding off the seating surface. The base 410 also includes shoulders 420 that extend upwardly from the lateral sides of the seating surface 412 and can function as armrest for a child seated therein. The seat back 430 is configured for supporting the back of child seated on the seating surface 412. In example embodiments, the seating surface 412, crotch restraint 414, shoulders 420 and seat back 430 are generally dimensioned to accommodate and infant-age child. Various other embodiments of the second child seat 400 can be dimensioned for supporting children of any age. The seat back 430 can include attached soft goods 432. In the depicted embodiment, the soft goods 432 are configured to extend over the seating surface 412. The seat back 430 can also include a safety harness 434 configured to secure an infant or child within the second child seat 400. In alternate embodiments, the second child seat 400 includes handles configured to provide an easy gripping surface for a user to grasp and move the second child seat.

Figure 18:
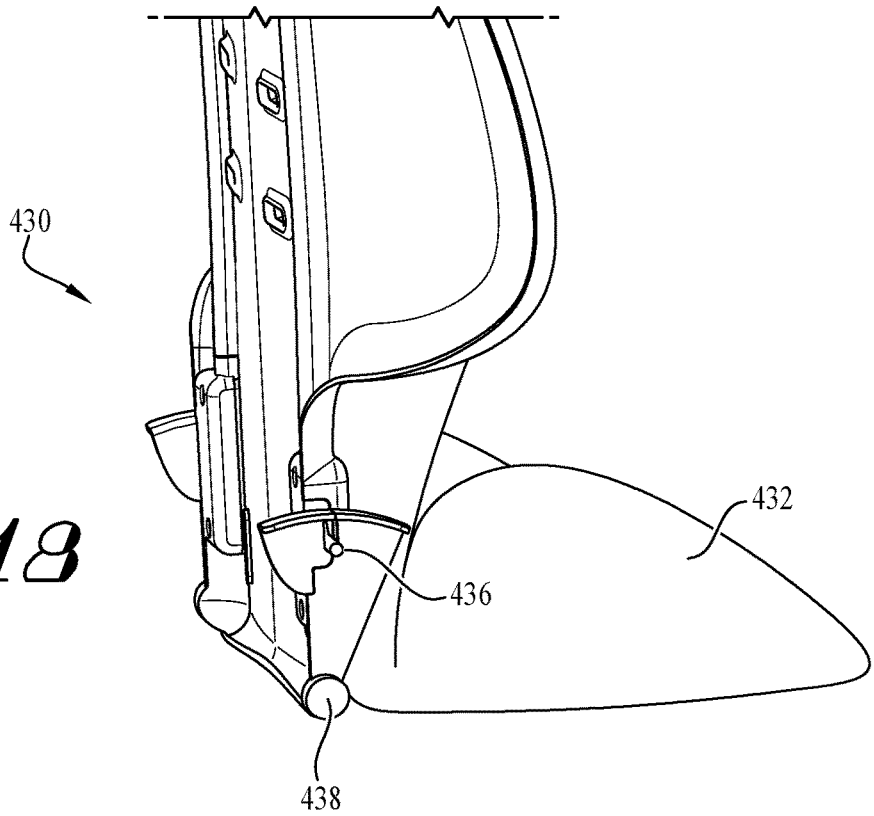
FIG. 18 shows a side view of the seat back of the second child seat of FIG. 16.
Figure 19:
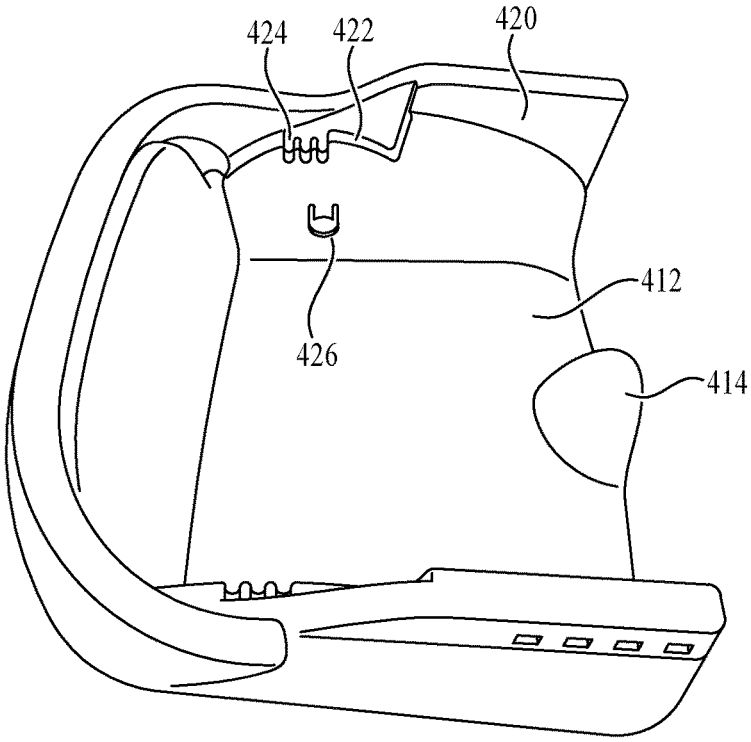
FIG. 19 shows a top view of the base of the second child seat of FIG. 16.

In example embodiments, the angle of recline between the seat back 430 and the seating surface 412 can be adjusted. As shown in FIGS. 18 and 19, the shoulder 420 of the seat base 410 includes a curved surface 422 with a series of positioning notches 424, corresponding to a series of recline angles, and a receiver 426. The seat back 430 includes a positioning pin 436 and a pivot projection 438. The pivot projection 438 is configured to pivotally couple with the receiver 426 such that the seat back 430 can pivot relative to the seating surface 412. The positioning pin 436 is configured to engage with a positioning notch 424 to hold the seat back 430 at a certain recline angle. To adjust the recline angle of the seat back 430, the user can lift the seat back to disengage the positioning pin 436 from a positioning notch 424 and slide the positioning pin along the curved surface 422 to engage the positioning notch corresponding to the desired recline angle.

Figure 20:
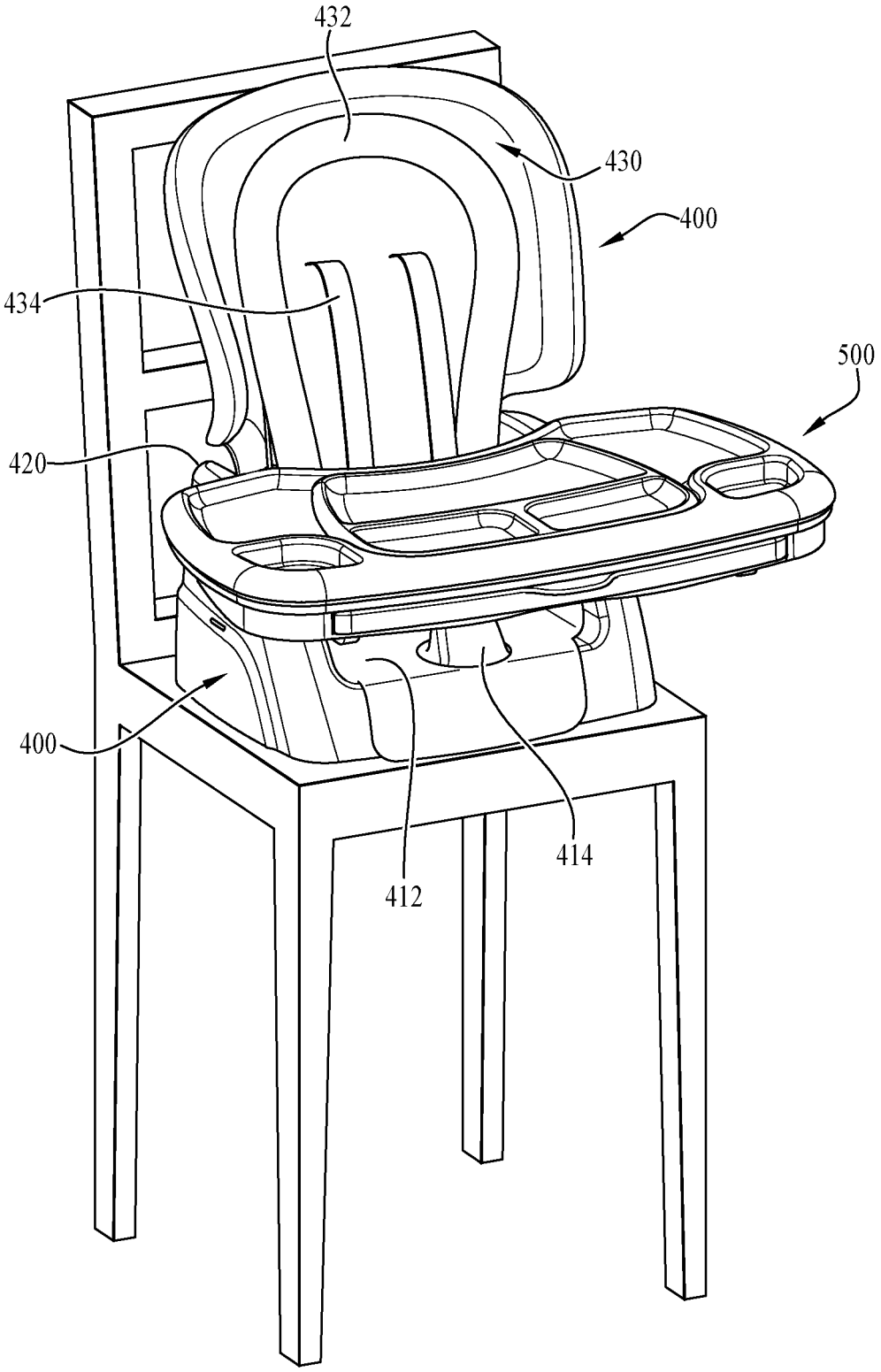
FIG. 20 is a perspective view of the second child seat of a convertible high chair in a third configuration and mode of use according to an example embodiment of the invention.
Figure 21:
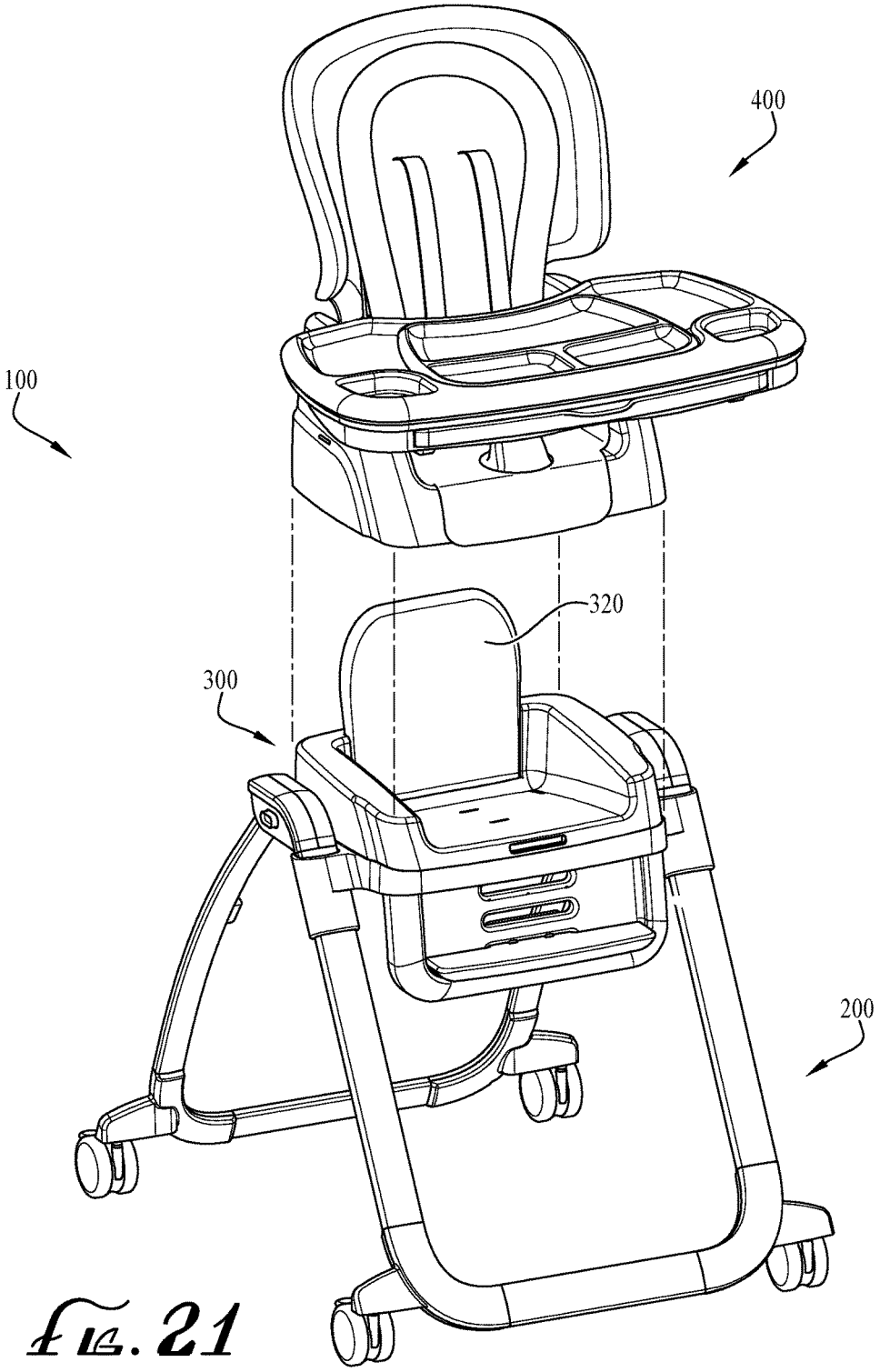
FIG. 21 is an exploded view of a convertible high chair in a first configuration according to an example embodiment of the invention.

The second child seat 400 can be attached to the first child seat 300 in a first configuration of the convertible high chair 100 as shown in FIGS. 1-3, for example for use as a high chair for an infant. FIG. 20 depicts the third configuration of the convertible high chair 100 in which the second child seat 400 is adapted as an infant booster seat. In this configuration, the second child seat 400 is configured for independent use apart from the high chair frame 200. The second child seat 400 is configured to rest on a separate support surface, for example, a generally flat seat surface of an adult dining chair. The bottom of the second child seat base 410 is configured to rest directly on the support surface, without the need for a separate base component. In example embodiments, straps are provided to secure the second child seat 400 to the adult dining chair or other support surface.

Figure 22:
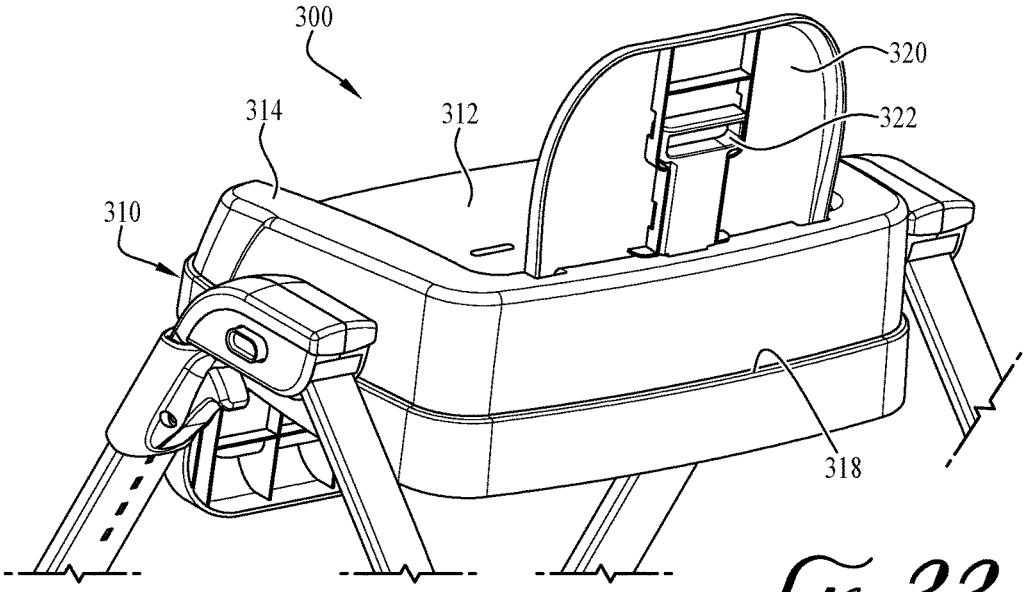
FIG. 22 shows a back view of the first child seat of the convertible high chair of FIG. 21.
Figure 23:
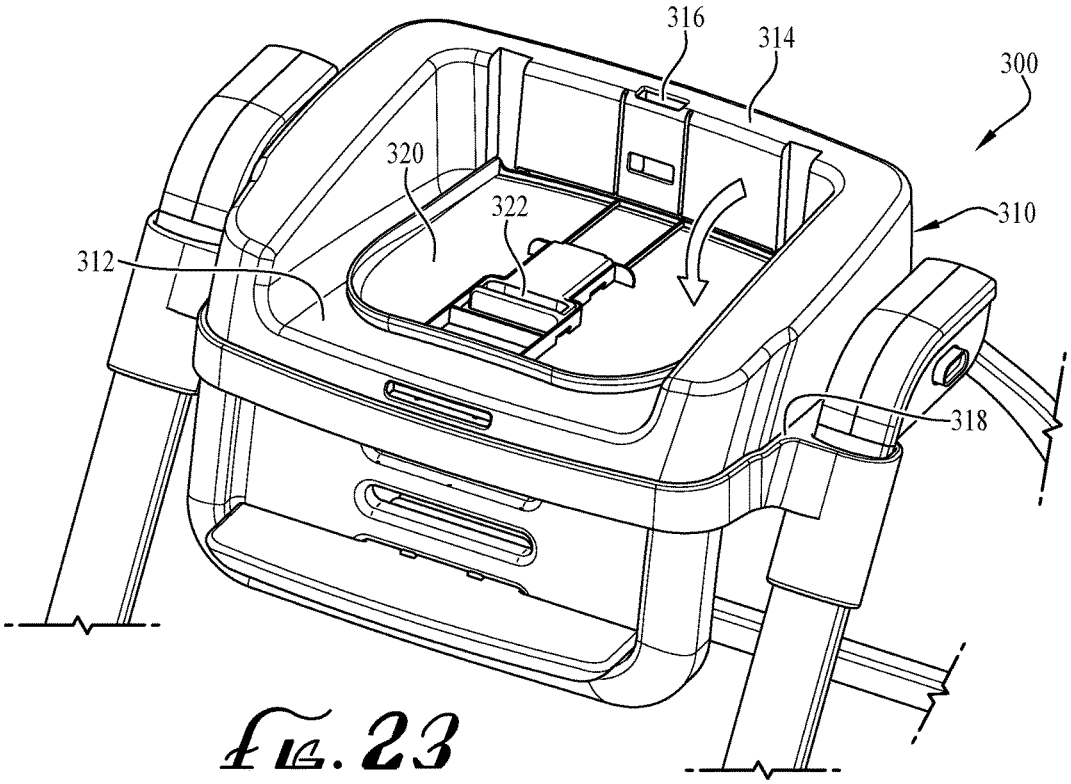
FIG. 23 shows a perspective view of the first child seat of the convertible high chair of FIG. 21.
Figure 24:
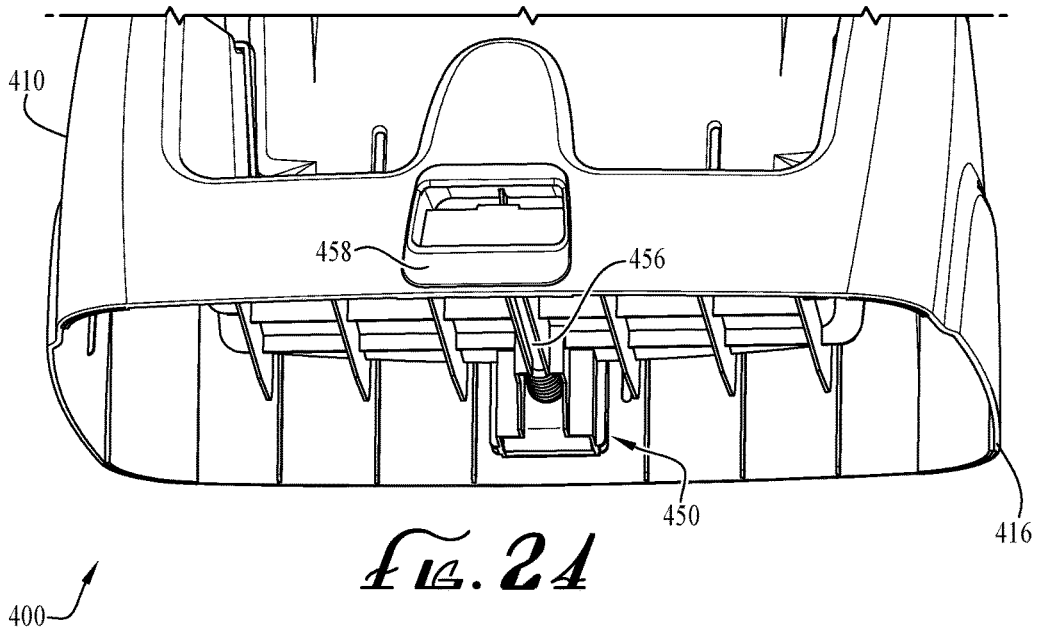
FIG. 24 shows a detailed view of the second child seat base of FIG. 21.
Figure 25:
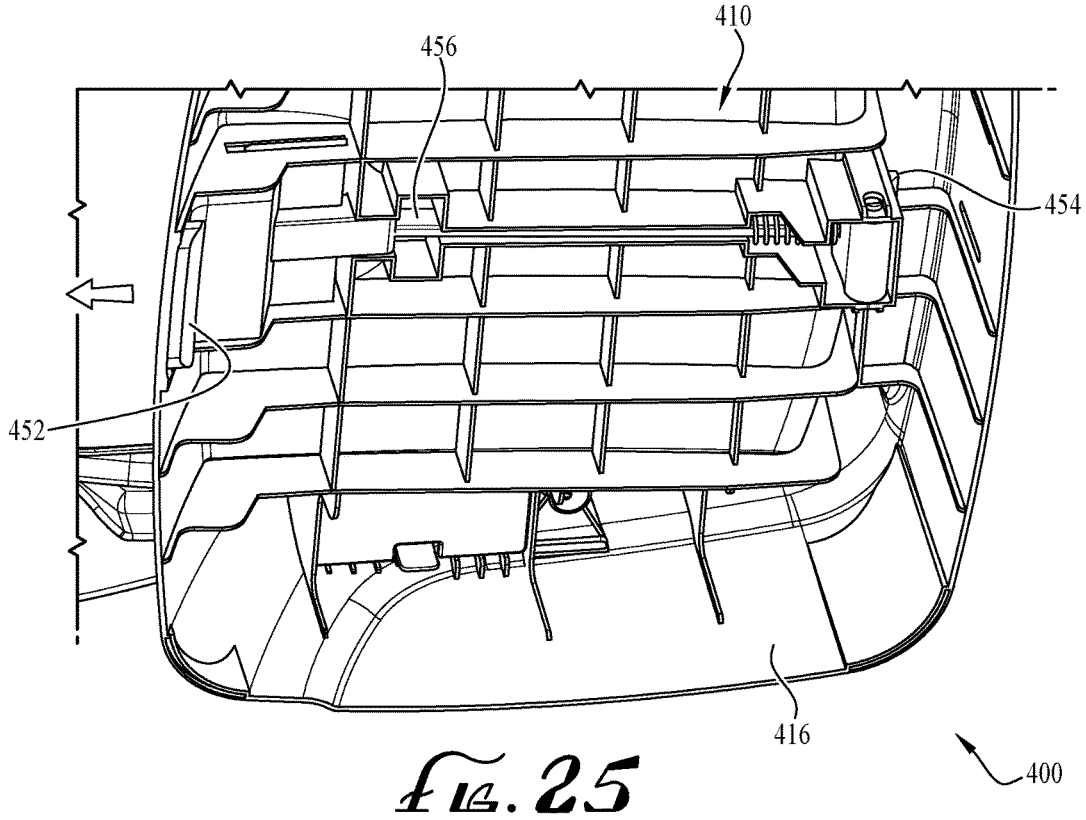
FIG. 25 shows a bottom view of the second child seat base of FIG. 26.
Figure 26:
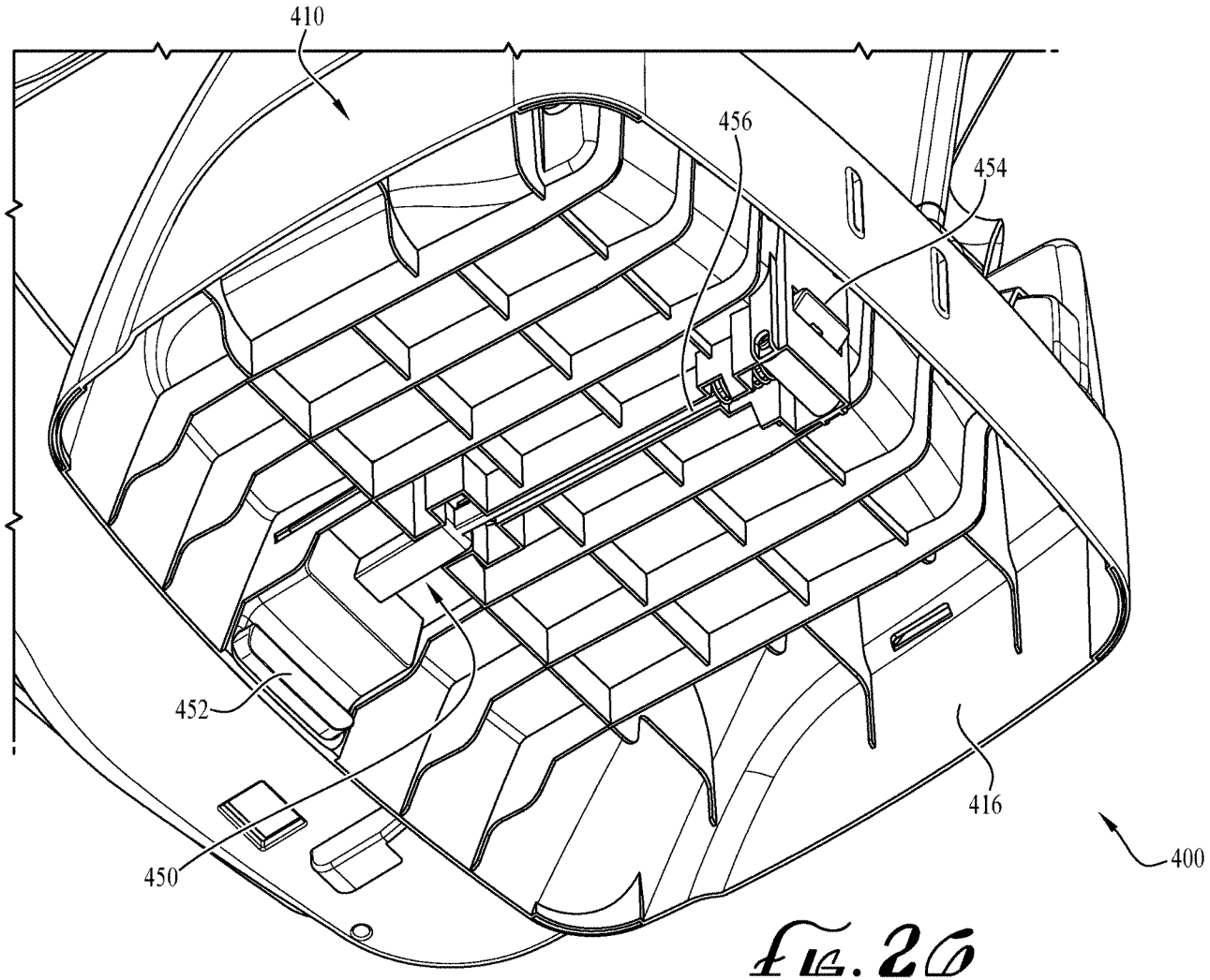
FIG. 26 shows a bottom view of the second child seat base of FIG. 26.
Figure 27:
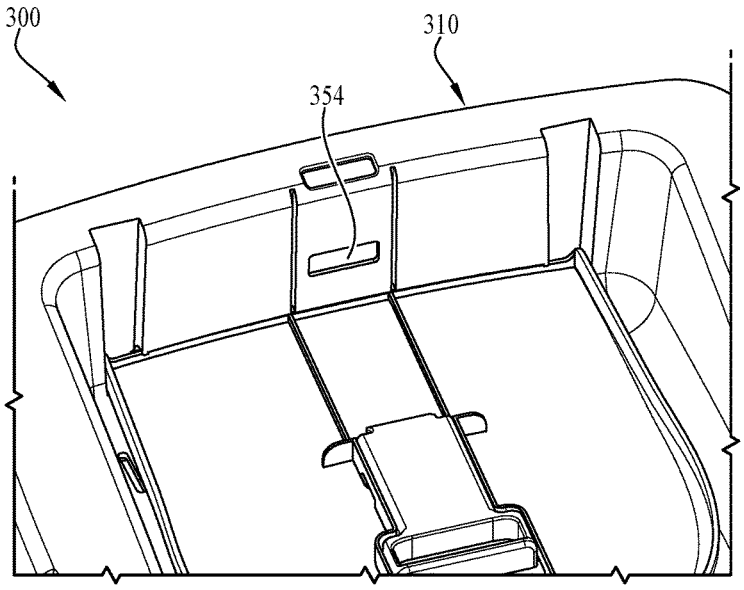
FIG. 27 shows a detailed view of the first child seat of FIG. 23.
Figure 28:
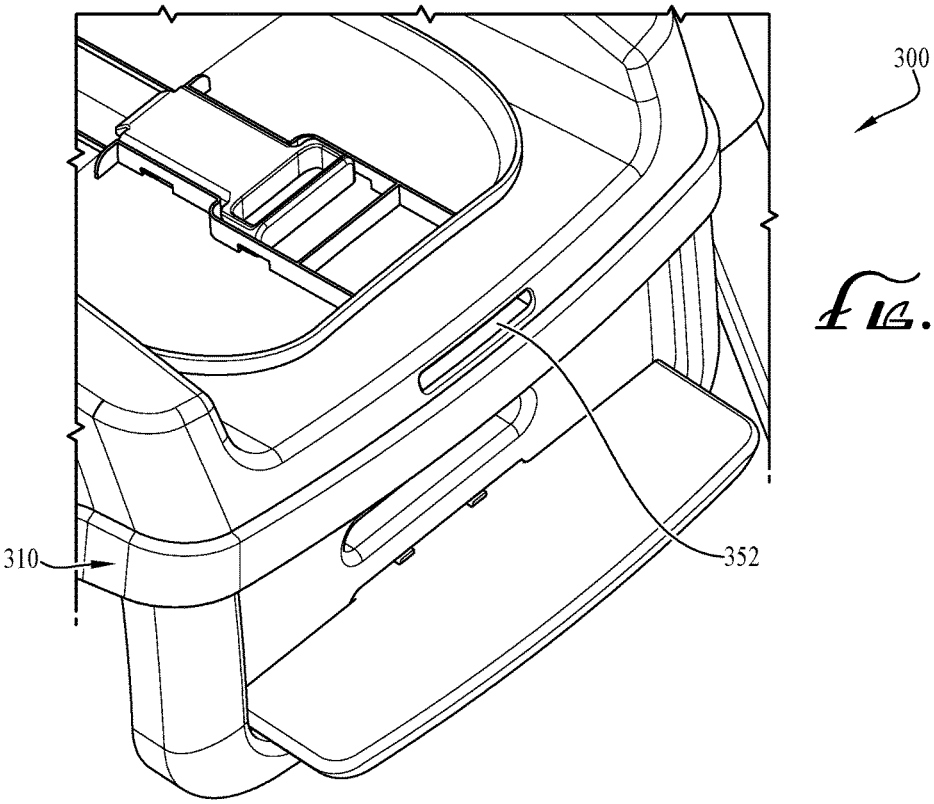
FIG. 28 shows a detailed view of the first child seat of FIG. 23.
Figure 29:
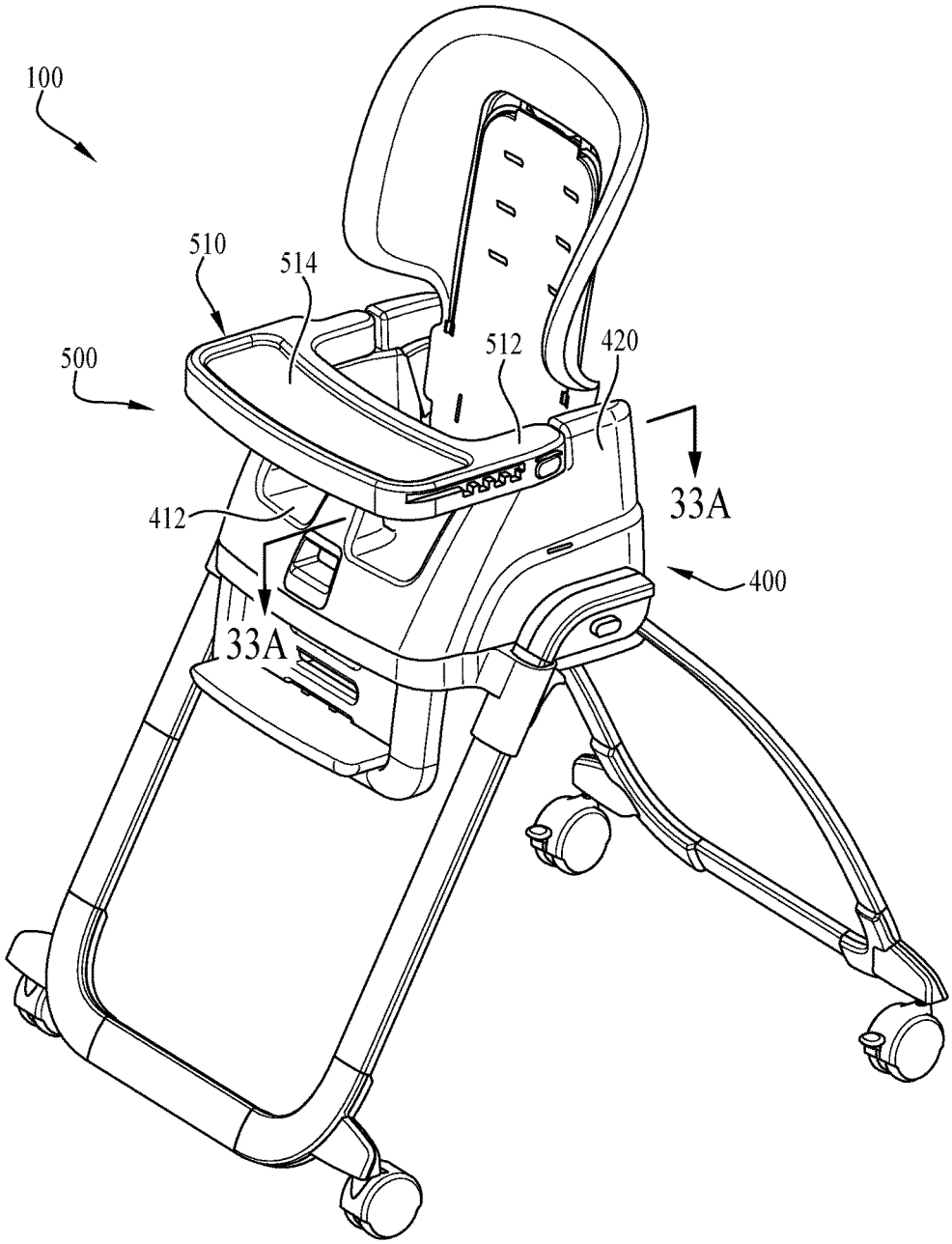
FIG. 29 is a perspective view of a convertible high chair in a first configuration according to an example embodiment of the invention.
Figure 31:
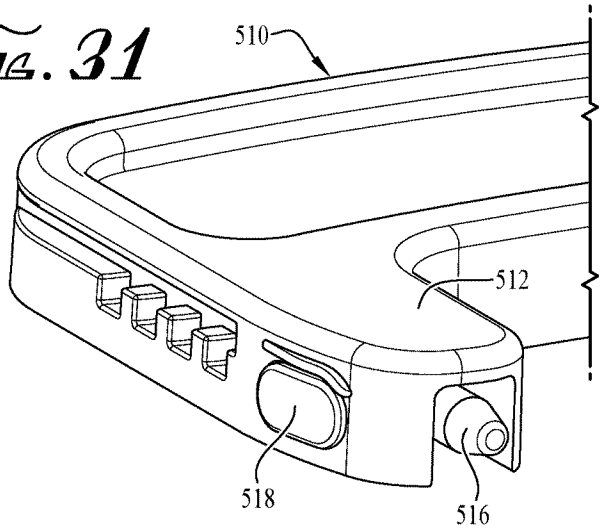
FIG. 31 shows a detailed view of a first arm of the tray of FIG. 30.
Figure 30:
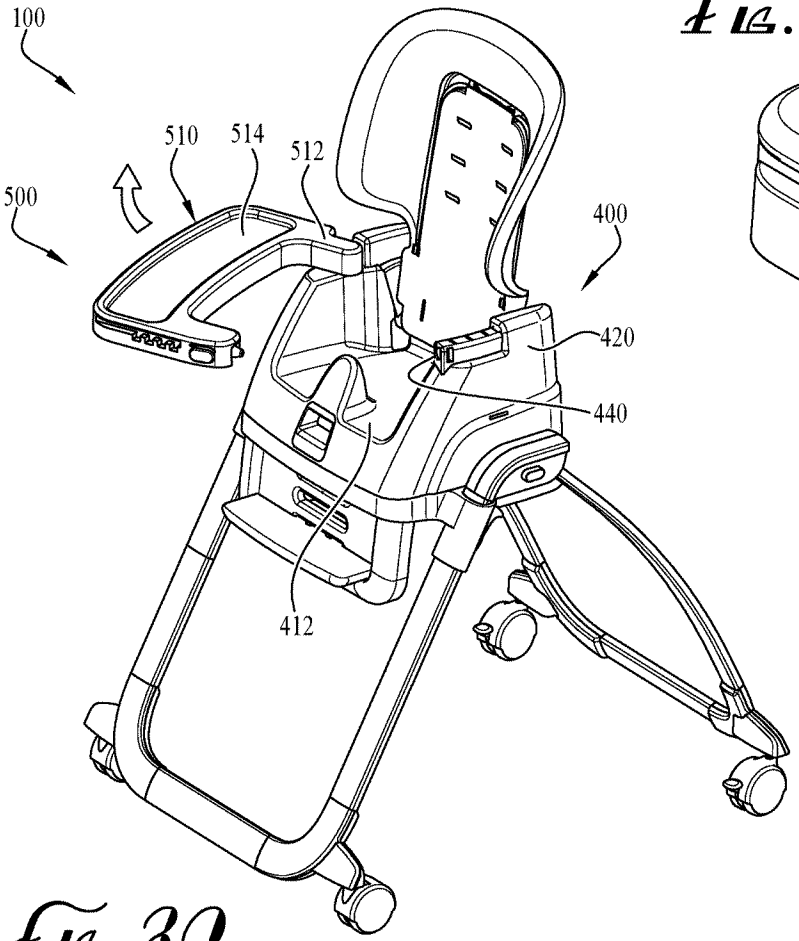
FIG. 30 shows the convertible high chair of FIG. 29 with the tray in an open pivoted position.

FIGS. 21-28 illustrate the mechanisms used to removably couple the second child seat 400 to the first child seat 300, and thereby to the frame 200. In the depicted embodiment, the back rest 320 of the first child seat 300 is moved to the folded position before the second child seat 400 is attached. As shown in FIGS. 22 and 23, the back rest 320 of the first child seat 300 includes a spring biased locking handle 322 configured to engage a slot 316 in the first child seat shoulder 314 which holds the back rest in the in-use position. To move the back rest 320 to the folded position, the user can pull the handle 322 to release it from the slot 316 and fold the back rest down such that it is substantially parallel to and abuts the seating surface 312. In alternate embodiments, the second child seat 400 can be coupled with first child seat 300 when the back rest 320 is in the in-use position or the back rest can be removed from the first child seat. In the depicted embodiment, the bottom of the base 410 of the second child seat 400 is dimensioned to fit over the first child seat 300. The base 410 of the second child seat 400 includes a downwardly extending lip or skirt 416 around its outer periphery, shown in FIG. 24, and the seat portion 310 of the first child seat 300 includes a ledge 318 around its outer periphery, shown in FIGS. 22 and 23. The lip 416 is configured to cover the seating surface 312 and shoulder 314 of the first child seat 300 and rest on ledge 318, as shown in FIG. 30. In example embodiments, the skirt 416 extends entirely around or substantially entirely around the outer periphery of the second child seat base 410. When coupled to the first child seat 300, the skirt 416 of the second child seat 400 extends around the entirety of the seat portion 310 of the first child seat 300, covering the front, back, and both sides of the first child seat. In the depicted embodiment, the first child seat 300 and second child seat 400 are dimensioned to have a flush outer surface when coupled together. Having the second child seat base 410 wider than the first child seat 300 creates stability, both when the second child seat 400 is in the first configuration or in use as a booster seat in the third configuration.

Figure 55:
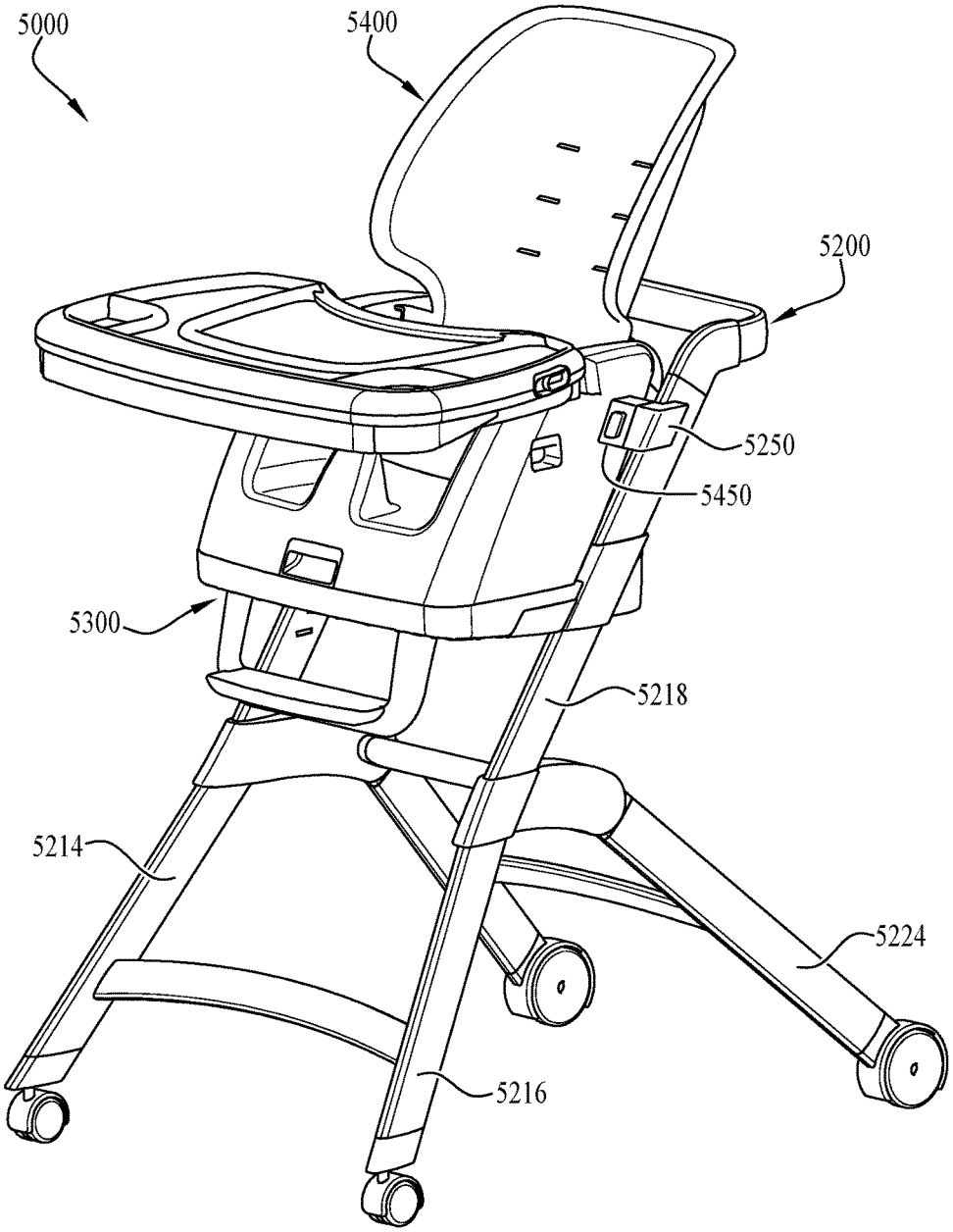
FIG. 55 is a perspective view of a convertible high chair according to another example embodiment of the invention.

In alternate embodiments of the high chair 5000, the second child seat 5400 attaches directly to the frame 5200, as opposed to attaching to the first child seat. As shown in FIG. 55, the frame can include attachment mechanisms 5250 configured to releasably engage with cooperating attachment mechanisms 5450 on the second child seat 5400. This high chair 5000 can also include the telescoping front upright frame member 5214 discussed above.

The second child seat 400 includes a locking latch and release mechanism 450, shown in FIGS. 24-28, configured to hold the second child seat 400 coupled to the first child seat 300. The locking mechanism 450 includes a first and second spring biased ridge 452, 454 coupled by a connecting rod 456 positioned on the bottom of the second child seat base 410 within the lip 416. The first ridge 452 in positioned adjacent the front of the base 410 and the second ridge 454 is positioned adjacent the back of the base. The first ridge 452 is connected to a release handle 458 that extends through the lip 416 at the front of the base. The first child seat 300 includes a first slot 352 positioned on the front of seat portion 310 and a second slot 354 positioned on the portion of shoulder 314 adjacent the back of the seating surface 312. The first and second ridge 452, 454 are configured to engage the first and second slot 352, 354 respectively when the second child seat 400 is coupled to the first child seat 300, thereby locking the second child seat to the first child seat. To release the second child seat 400 from the first child seat 300, the user pulls the release handle 348 which laterally moves and retracts the first and second ridge 452, 454 from the first and second slot 352, 354 and enables the second child seat 400 to be removed from the first child seat 300.

Figure 54:
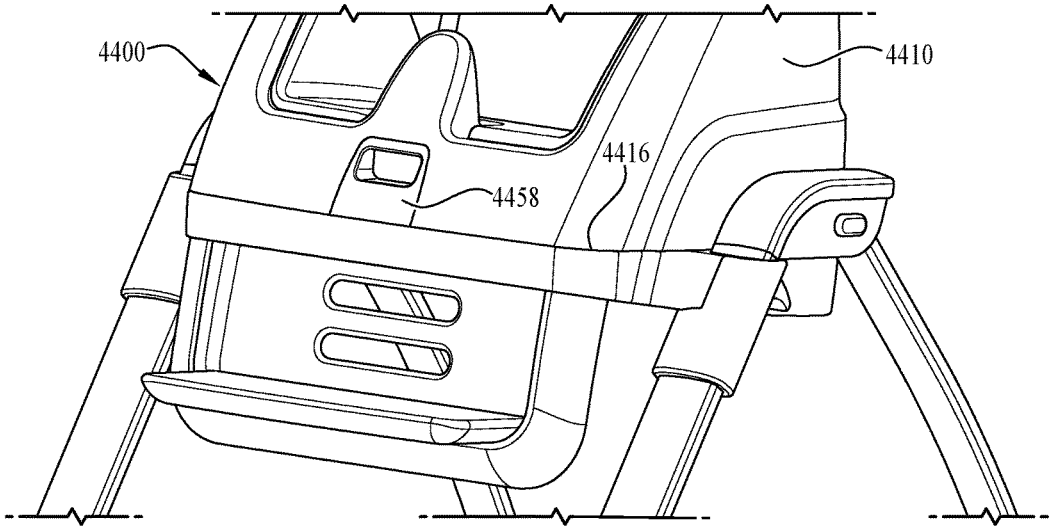
FIG. 54 is a detailed perspective view of a second child seat of a convertible high chair according to another example embodiment of the invention.

In other embodiments, the second child seat 4400 includes a locking latch and release mechanism as discussed above. But in this embodiment, the seat release handle 4458 extends to the bottom edge of the skirt 4416 of the second child seat 4400, as shown in FIG. 54. This configuration strengthens the base 4410 of the second child seat 4400 and makes the base easier to manufacture.

Figure 32:
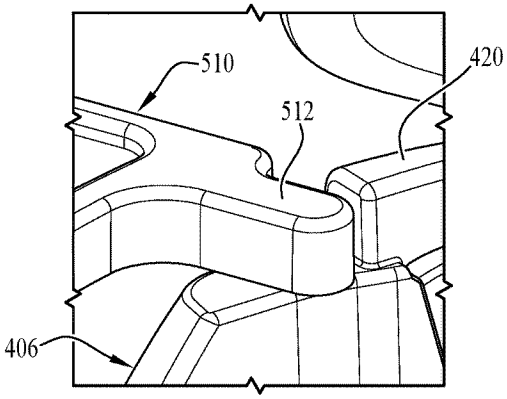
FIG. 32 shows a detailed view of the second arm of the tray of FIG. 30
Figure 33A:
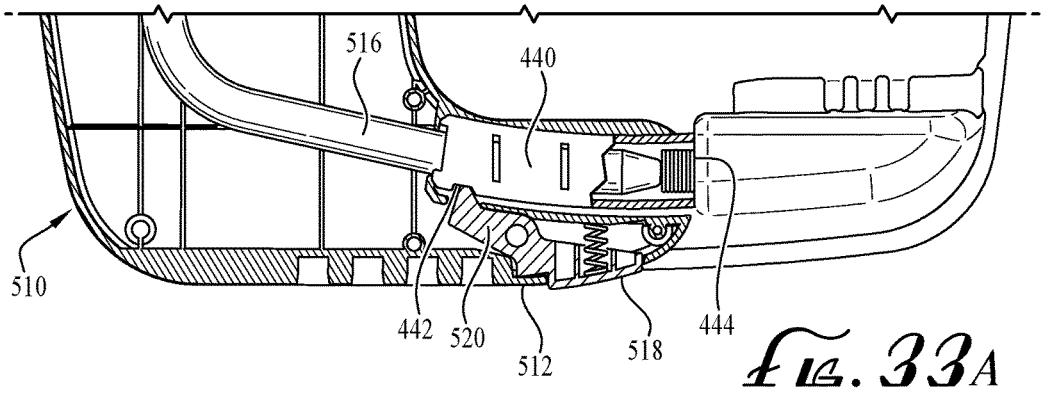
FIGS. 33A-C show a cut-away view of the first arm of tray of FIG. 29, and a sequence of operation of its release mechanism.
Figure 33B:
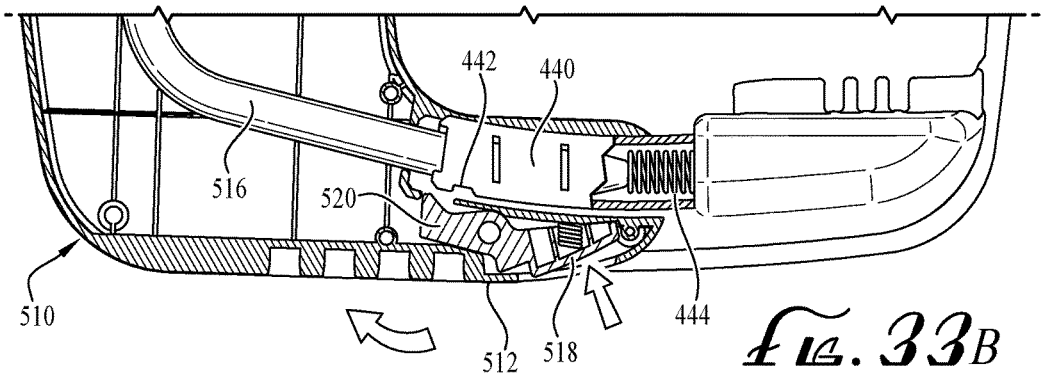
Figure 33C:
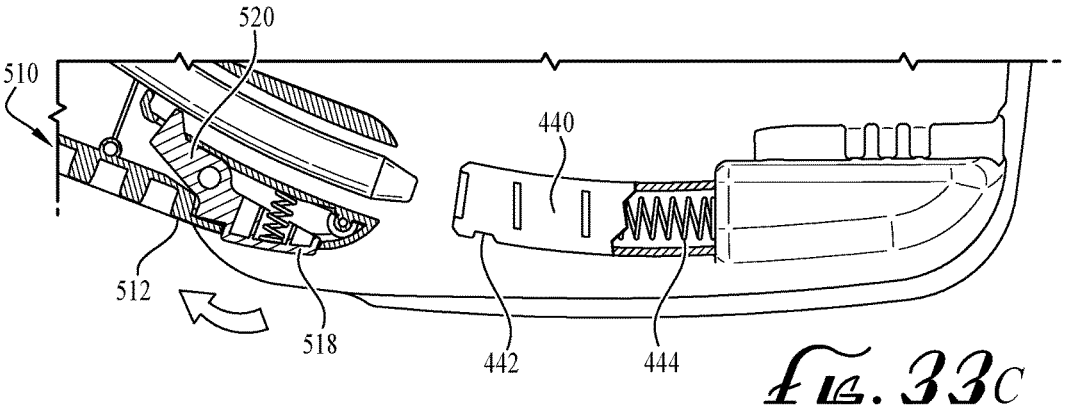
Figure 34:
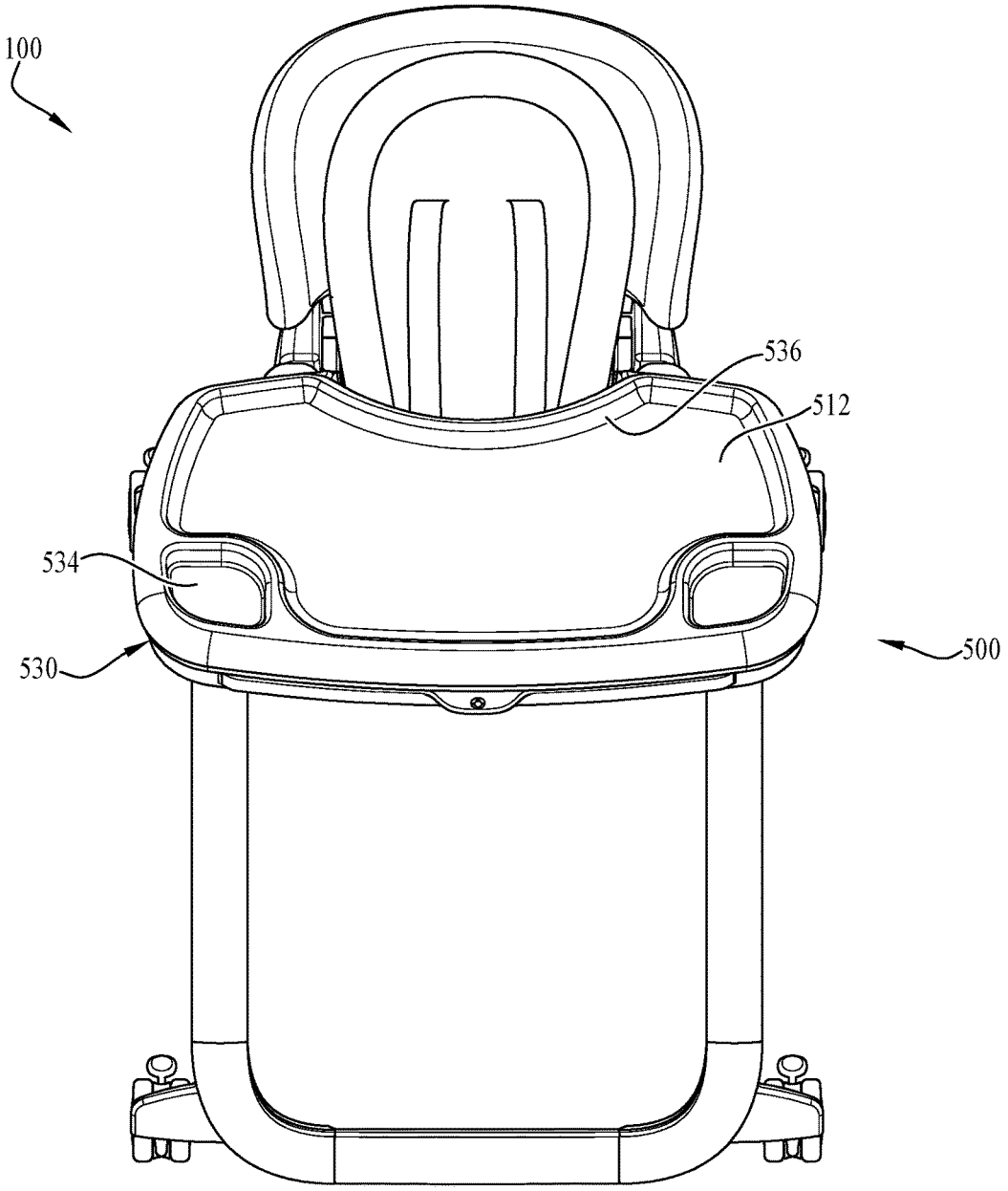
FIG. 34 is a top view of a convertible high chair in a first configuration with a detachable tray according to an example embodiment of the invention.
Figure 35:
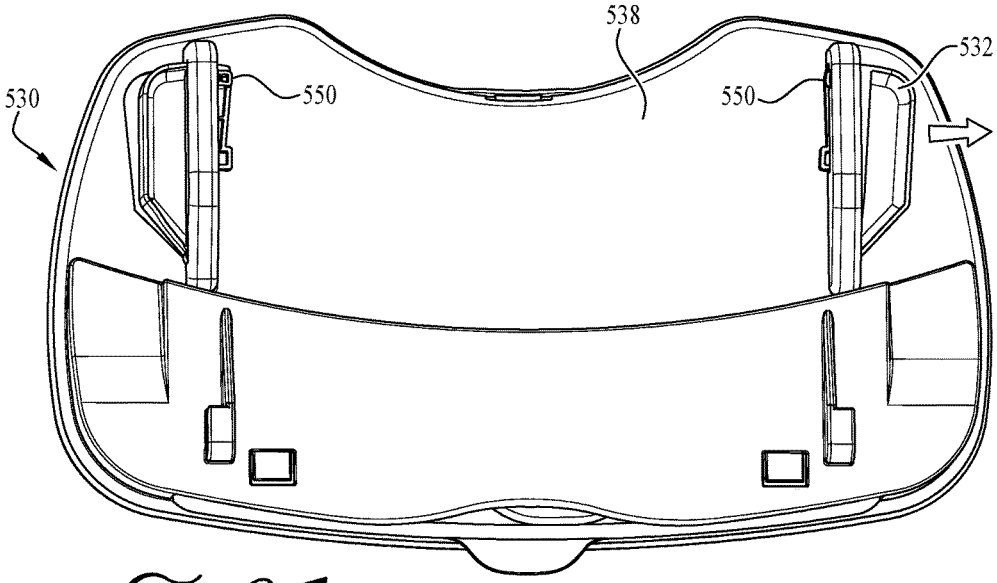
FIG. 35 shows a bottom view of the detachable tray of FIG. 34.

A multi-tray tray assembly 500 is shown according to example embodiments in FIGS. 29-47, and generally includes a base tray 510 and a larger detachable tray 530. Optionally, the tray assembly 500 includes an auxiliary tray 540, a tray liner 560 and a plate 570. The base tray 510, shown in FIGS. 29-33 generally includes two arms 512 and a substantially rectangular work surface 514. The base tray 510 can include a lip around the outer periphery of the upper surface, but generally provides a substantially flat planar surface for holding food, toys or other items in a location accessible by the child seated in the high chair 100. The arms 512 of the base tray 510 are coupled to the shoulder 420 of the second child seat 400. The base tray 510 is positioned such that the seating surface 412 of the second child seat 400 is between the arms 512 of the base tray 510. One arm 512 is pivotally coupled to the shoulder 420, as shown in FIG. 32, and the other arm is releasably coupled to the shoulder so that the base tray 510 can be pivoted away from the second child seat 400, as shown in FIG. 30. This feature helps the caregiver access the second child seat 400 when seating or removing the child. The arm 512 with the releasable coupling includes a plunger 516. The plunger 516 is configured to fit within a channel 440 in the shoulder 420. The plunger 516 includes a locking mechanism comprising a spring biased button 518 coupled to an arm 520. The arm 520 is configured to engage a notch 442 on the outside of the channel 440 to lock the plunger 516 in engagement with the channel, as shown in FIG. 33A. The user can depress the button 518 to move the arm 520 out of engagement with the notch 442 in order to release the plunger 516 from the channel, as shown in FIGS. 33B and 33C. In example embodiments, the channel includes a spring 444 biasing the plunger 516 away from the channel 428 such that when the locking mechanism is unlocked, the plunger is spring-ejected from the channel. In the depicted embodiment, the button 518 is positioned on the side of the arm 512 such that it is not easily visible to or accessible by a child seated in the second child seat 400. In alternate embodiments, various other forms of release mechanism can be provided.

Figure 36:
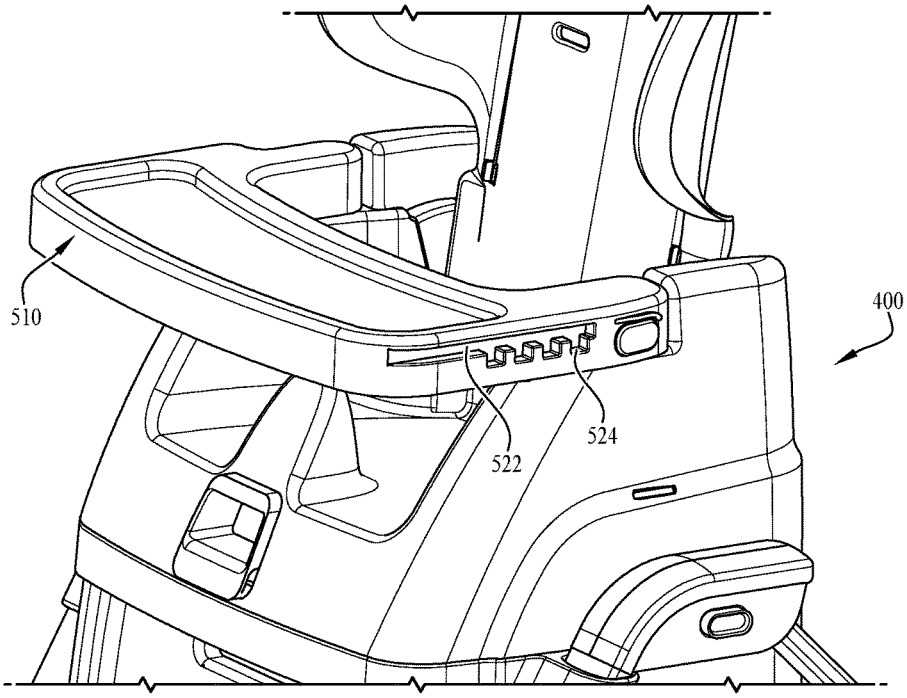
FIG. 36 shows a detailed side view of the base tray of FIG. 34.
Figure 38:
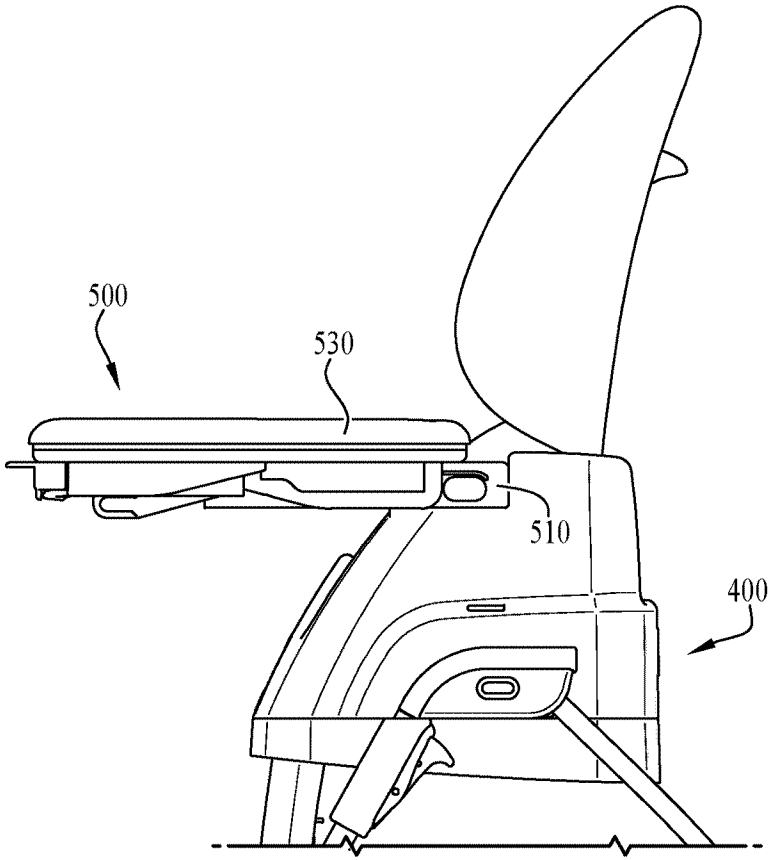
FIG. 38 shows a side view of the convertible high chair of FIG. 34 with the detachable tray in a second position.
Figure 37:
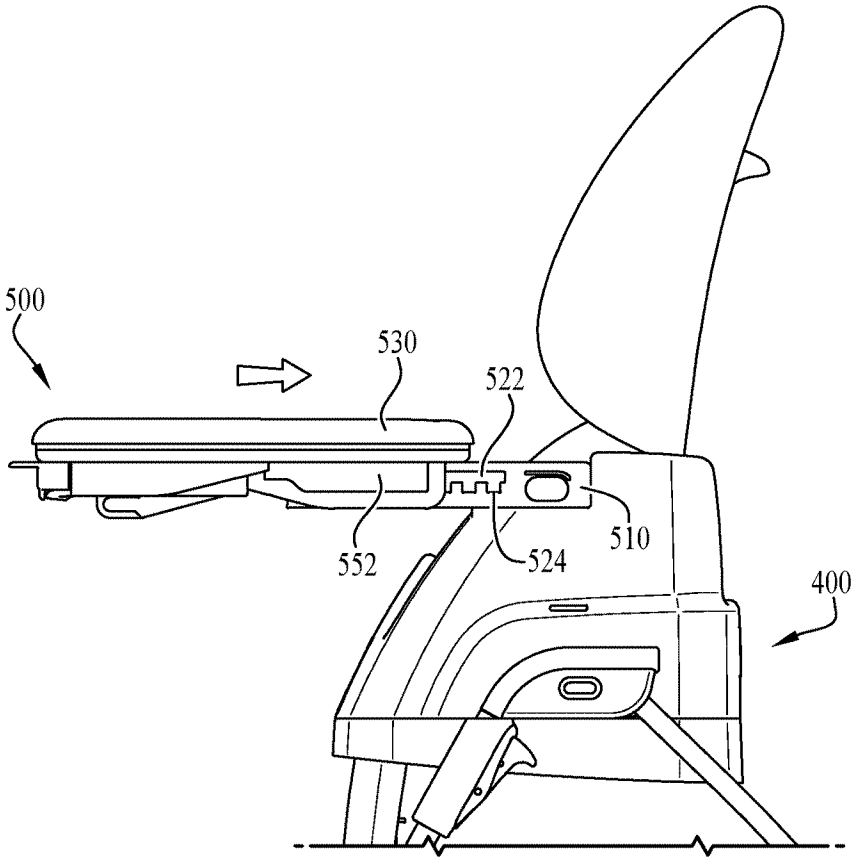
FIG. 37 shows a side view of the convertible high chair of FIG. 34 with the detachable tray in a first position.
Figure 40:
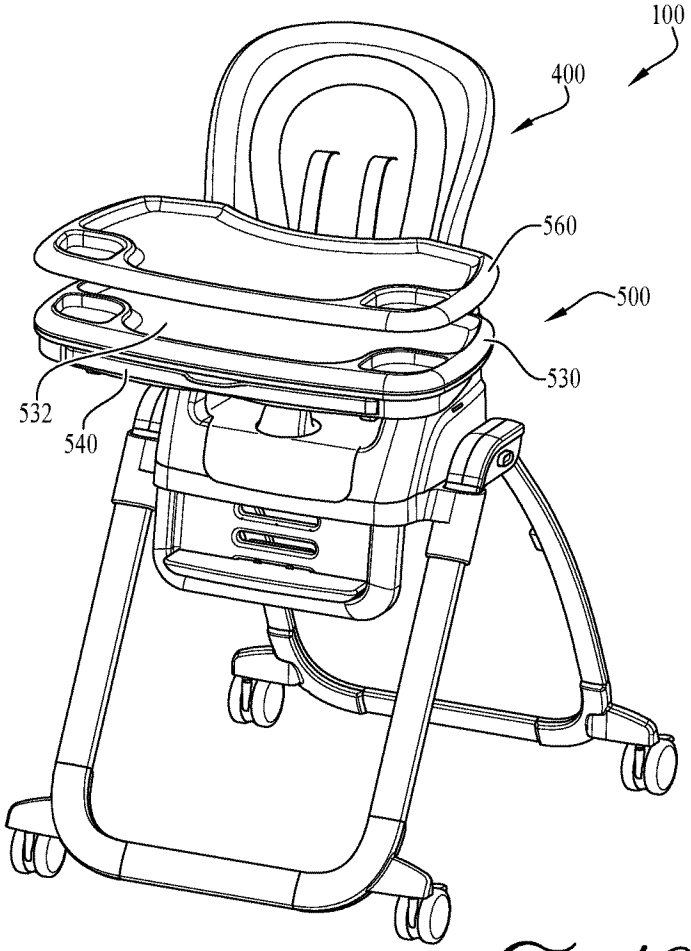
FIG. 40 shows the convertible high chair of FIG. 34 with a tray liner separated from the tray according to an example embodiment of the invention.

The detachable tray 530, shown in FIGS. 34-38, can be detachably coupled to the base tray 510. The detachable tray 530 has a generally rectangular shape with a substantially flat upper tray surface 512. The upper tray surface can include one or more partitioned sections 534 that can be used to hold food and other items, such as children's toys. The sections 534 can also be used as cup holders. In example embodiments, the cup holder 534 has a generally teardrop shape which can help prevent a square object, such as a juice box, from becoming wedged in the cup holder. The detachable tray 530 can include a lip around its periphery. In the depicted embodiment, the detachable tray 530 includes a scooped lip 536 along the portion of the tray proximal to a child seated in the second child seat. The scooped lip 536 is formed from a curved edge that forms an inward facing wave-shape designed to assist an infant in gathering and scooping objects, such as small food. The bottom surface 538 of the detachable tray 530, depicted in FIG. 35, includes two spring biased attachment ribs 550 pivotally mounted to the bottom surface for coupling the detachable tray to the base tray 510. Each attachment rib 550 includes a handle 552 for pivoting the rib out of the spring biased locked position. In the depicted embodiment, the ribs 550 are positioned such that the detachable tray 530 will be generally centered on the base tray 510. In alternate embodiments, the ribs 550 are configured such that the detachable tray 530 will be offset relative to the base tray 510. The side of each arm 512 of the base tray 510 includes a channel 522 with a plurality of notches or stop surfaces 524 configured to correspond with positions of the detachable tray 530 relative to second child seat, as shown in FIG. 36. The detachable tray 530 is coupled to the base tray 510 by fitting the attachment ribs 550 into the corresponding channels 520. The ribs 550 are configured to engage a notch 524 to lock the detachable tray 530 to the base tray 510. The user can actuate the handles 552 to move the ribs 550 out of engagement in order to remove the detachable tray 530 from the base tray 510 or adjust the position of the detachable tray relative to the second child seat 400, as shown in FIGS. 37 and 38. In alternate embodiments, another coupling mechanism can be used.

Figure 39:
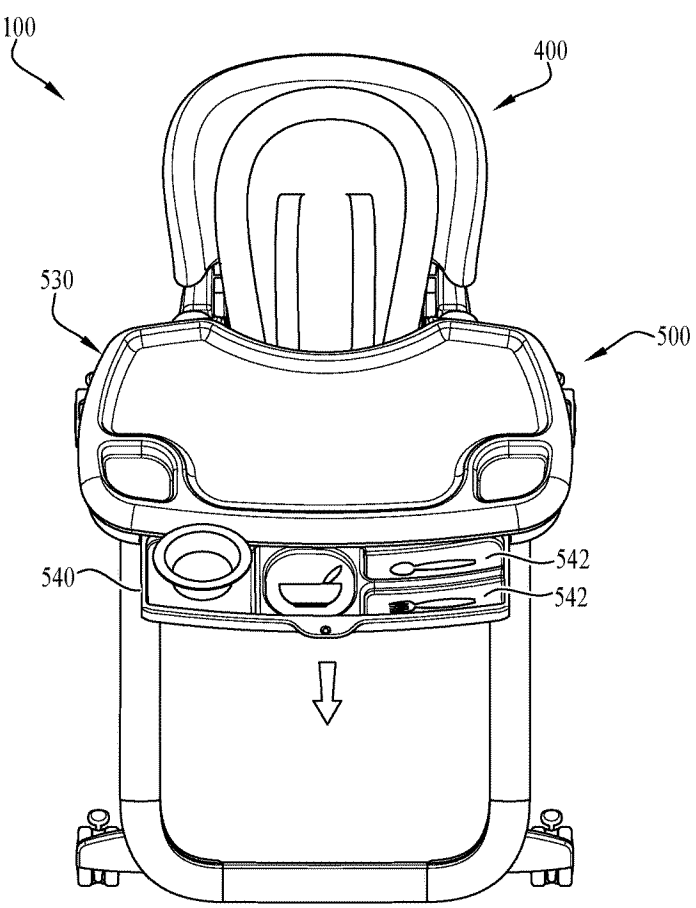
FIG. 39 shows the convertible high chair of FIG. 34 with an auxiliary tray extended according to an example embodiment of the invention.

The detachable tray 530 can optionally also include an auxiliary tray 540 positioned within the detachable tray in a drawer-like configuration that permits a user to slide the auxiliary tray into and out of view, as shown in FIG. 39. The auxiliary tray 540 is located at a distal or front end of the tray assembly 500 or is otherwise situated such that a child seated in the second child seat 400 cannot access items on the auxiliary tray. The auxiliary tray 540 is designed to provide space for a parent or other adult caregiver to store and stage items out of reach and/or view of the child or infant. The auxiliary tray 540 can include partitioned sections 542 for holding utensils, food, toys or other items. In example embodiments, the auxiliary tray 540 is detachable from the detachable tray 530 so that the caregiver can clean the tray or prepare food and drink at a different location before recoupling to the detachable tray. In other embodiments, the auxiliary tray 540 includes a liner that can be detached for cleaning. The auxiliary tray 540 can include a lip on the bottom surface to facilitate sliding the auxiliary tray away from the detachable tray 530.

Figure 41:
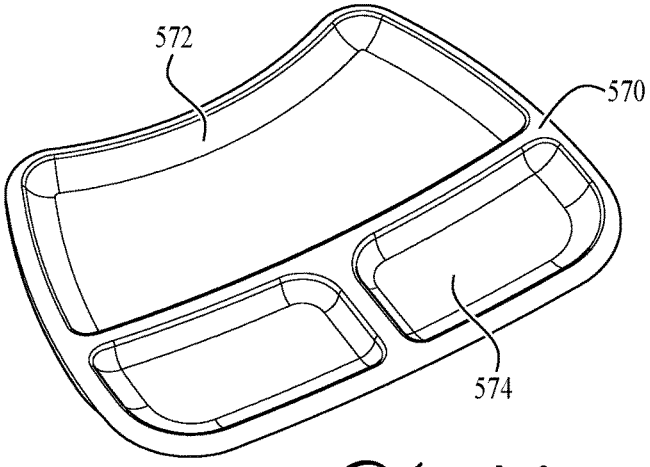
FIG. 41 is a perspective view of a tray plate accessory according to an example embodiment of the invention.
Figure 42:
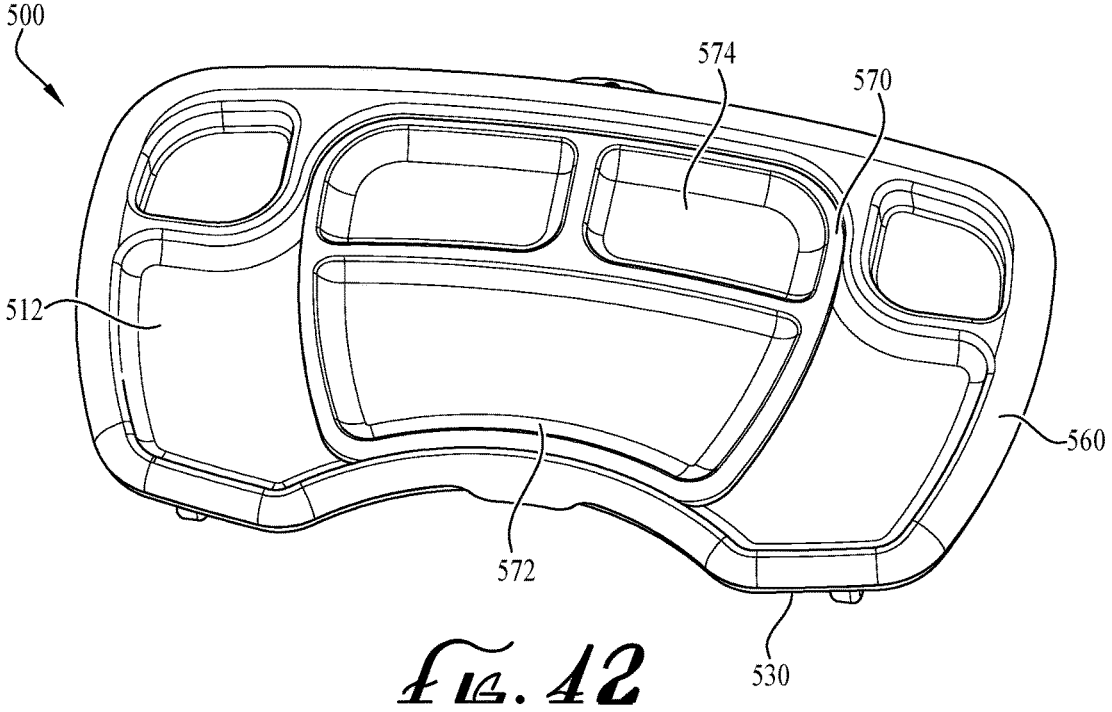
FIG. 42 is a top view of a tray assembly including the tray plate accessory according to an example embodiment of the invention.

The tray assembly 500 can optionally also include a liner 560 dimensioned to nest over the upper surface 532 of the detachable tray 530. The liner 560 can be removed from the detachable tray for cleaning and is preferably formed from a dishwasher safe material. In example embodiments, the liner 560 is formed from a translucent material. In alternate embodiments, the liner 560 can include designs or depictions of characters or objects. The tray assembly 500 can optionally also include a plate 570 configured to nest in the detachable tray 530 or detachable tray liner 560, as shown in FIGS. 41 and 42. The plate 570 can also include a scooped lip 572 designed to assist an infant in gathering and scooping object. The plate 570 can include partitioned sections 574 for holding food and other items. The plate 570 can rest on the upper or tray surface 512 or can be configured to clip or lock onto the upper tray surface.

Figure 43:
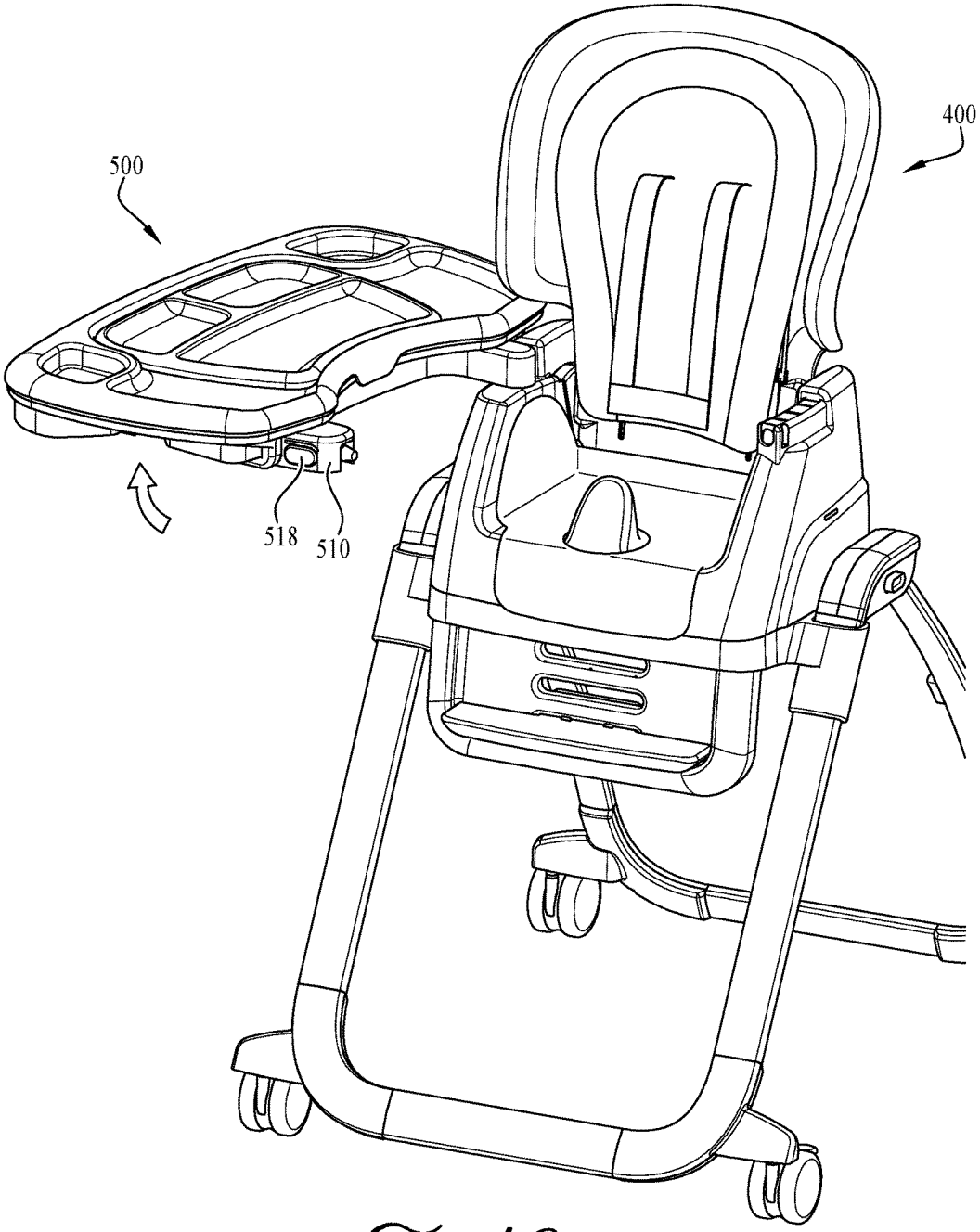
FIG. 43 is a perspective view of a convertible high chair in a first configuration with a tray assembly in a pivoted position according to example embodiments of the invention.
Figure 45:
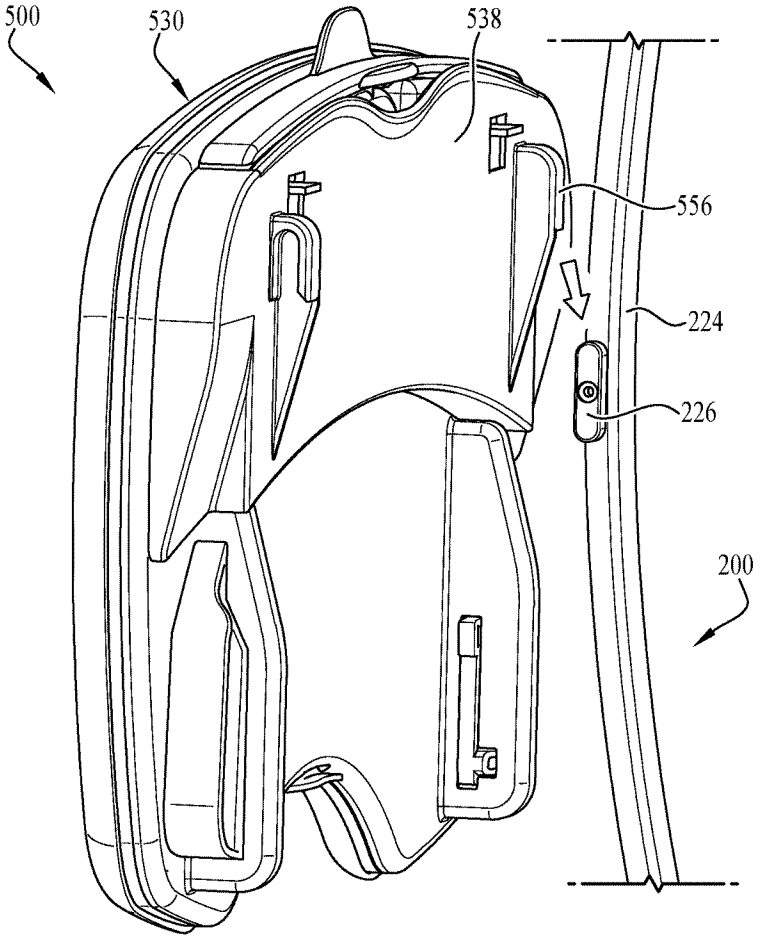
FIG. 45 shows a detailed view of the bottom of the tray assembly and back vertical frame member of FIG. 43.
Figure 44:
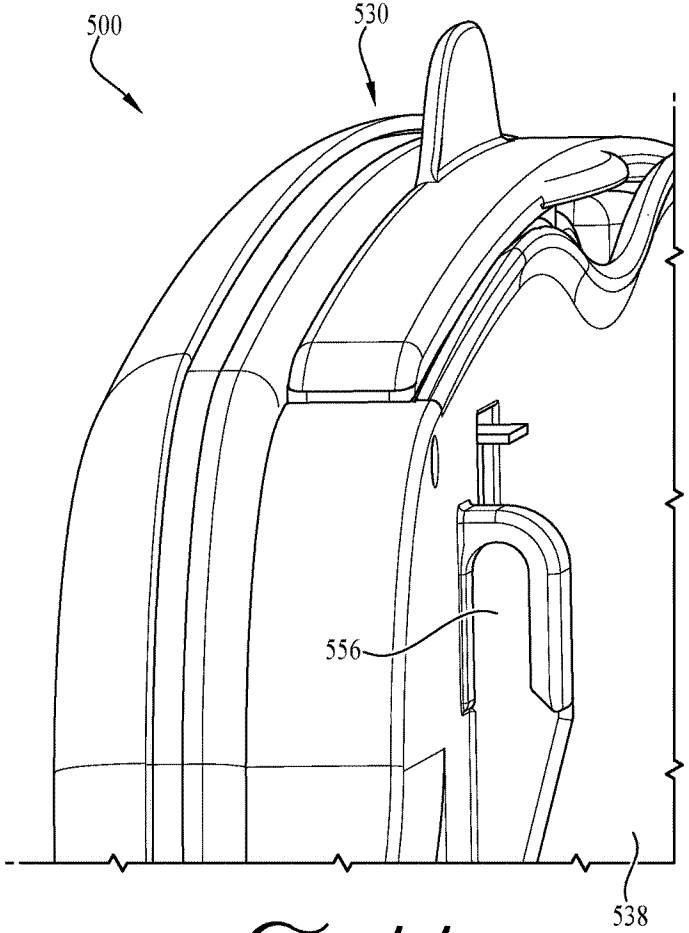
FIG. 44 shows a detailed view of the bottom of the tray assembly of FIG. 43.
Figure 47:
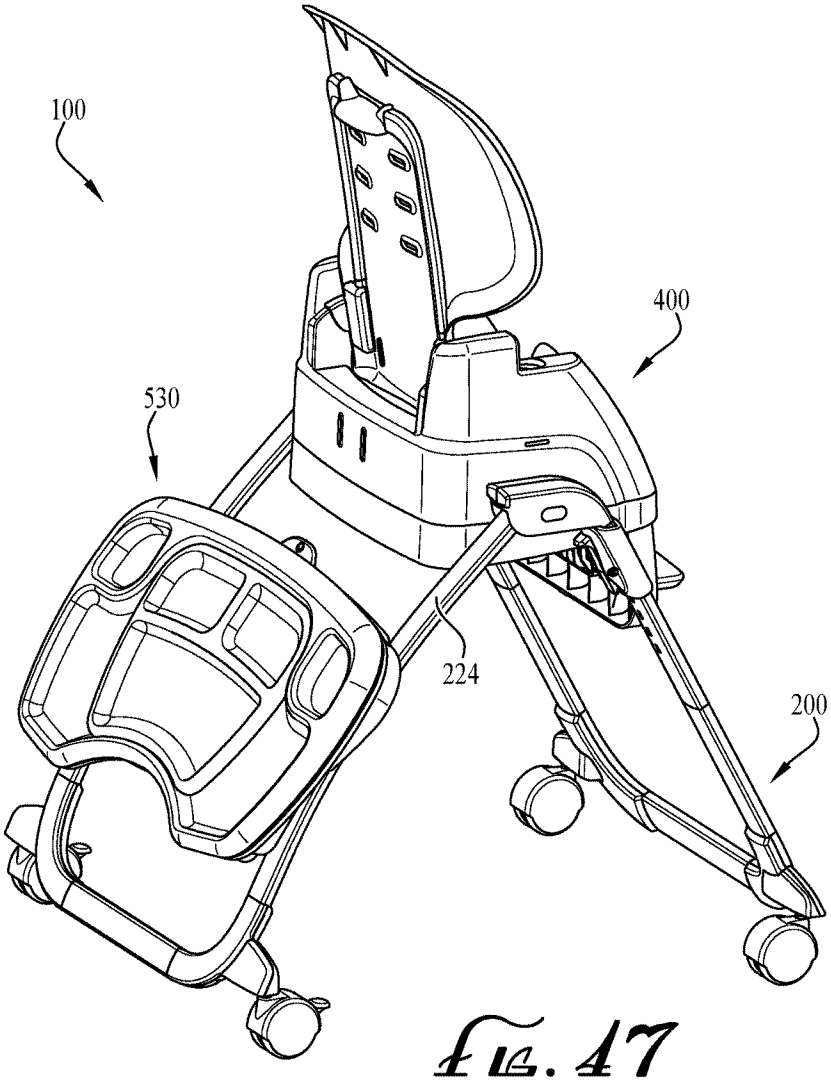
FIG. 47 is a perspective view of a convertible high chair in a first configuration with the detachable tray in a hanging storage position.
Figure 46:
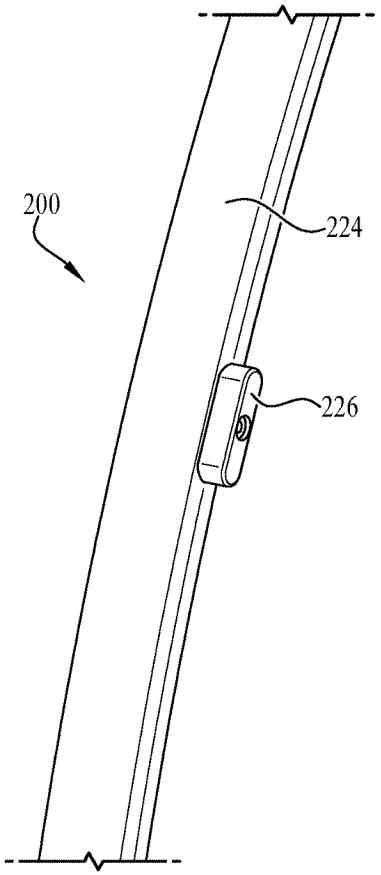
FIG. 46 shows a detailed view a back vertical frame member of FIG. 43.
Figure 49:
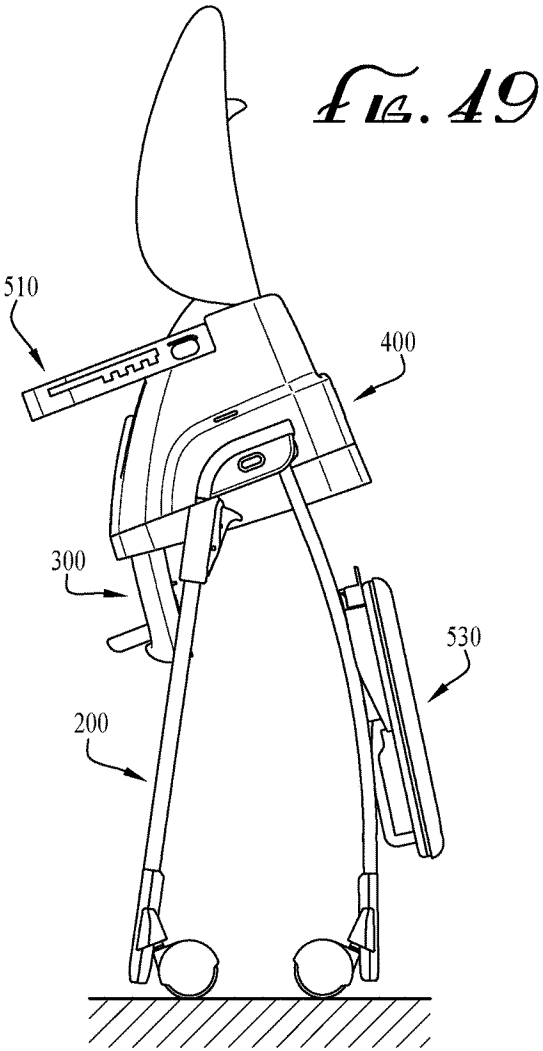
FIG. 49 shows a side view of the convertible high chair of FIG. 47 in a folded position.
Figure 48:
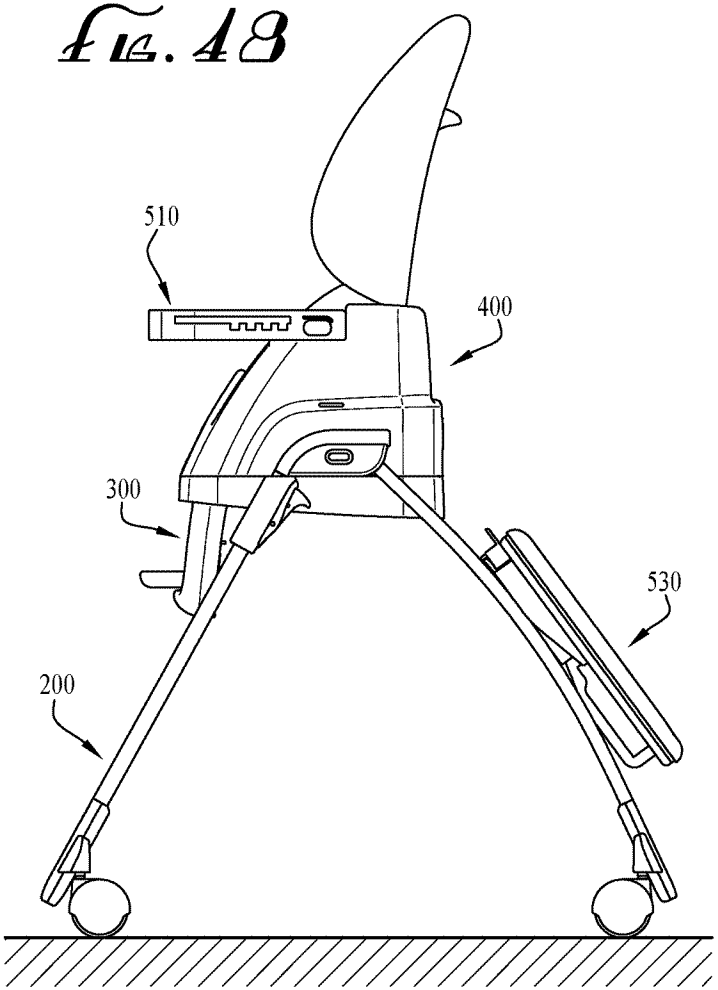
FIG. 48 shows a side view of the convertible high chair of FIG. 47.

As shown in FIG. 43, the entire tray assembly 500 can be pivoted away from the second child seat 400 using the pivot function of the base tray 510 described above. In the depicted embodiment, the release button 518 on the base tray 510 is still accessible when the detachable tray 530 is coupled to the base tray. The detachable tray 530 can also be stored on the high chair frame 200 when decoupled from the base tray 510. FIGS. 44 and 45 depict hooks or notches 556 protruding from the bottom surface 538 of the detachable tray 530. FIGS. 45 and 46 depict a tab 226 positioned on the back vertical frame member 224. In the example embodiment, each back vertical frame member 224 includes a tab 226 along its inward face. The notches 556 are fitted over the tabs 226 to hang the detachable tray 530 from the back vertical frame members 224, as shown in FIG. 47. In example embodiments, as shown in FIGS. 48 and 49, the convertible high chair 100 is configured to stand upright and roll for portability with the frame 200 in the compact folded position with the second child seat 400 coupled to the first child seat 300 and the detachable tray 530 hung from the back vertical frame member 224.

While the invention has been described with reference to example embodiments, it will be understood by those skilled in the art that a variety of modifications, additions and deletions are within the scope of the invention, as defined by the following claims.

What is claimed is:

1. A convertible high chair comprising:

a frame configured to rest on a floor;

a first child seat defining a first seating surface, the first child seat being coupled to the frame and supported above the floor, wherein the first child seat comprises a foldable backrest;

a second child seat defining a second seating surface, a first shoulder, and a second shoulder, the second child seat configured for being removably coupled over at least a portion of the first child seat when the backrest of the first child seat is folded; and a tray assembly comprising a base tray comprising a first arm pivotally coupled to the first shoulder of the second child seat and a second arm releasably coupled to the second child seat and a detachable tray removably coupled to the base tray, wherein the detachable tray comprises one or more actuatable handles, wherein the actuatable handles are configured to actuate to slidingly adjust the detachable tray relative to the base tray and to remove the detachable tray from the base tray.

2. The convertible high chair of claim 1, wherein the detachable tray includes one or more partitioned sections.

3. The convertible high chair of claim 1, wherein the detachable tray includes an auxiliary tray slidingly coupled to the detachable tray.

4. The convertible high chair of claim 1, wherein in the tray assembly further comprises a tray liner configured to nest over the detachable tray.

5. The convertible high chair of claim 1, wherein the detachable tray is configured to detachably couple with the frame in a storage position.

6. The convertible high chair of claim 1, wherein the detachable tray comprises a scooped lip configured to assist an infant in gathering and scooping objects.

7. The convertible high chair of claim 1, wherein the base tray comprises a releasable coupling proximate the second arm for releasing the second arm from the second shoulder.

8. The convertible high chair of claim 7, wherein the releasable coupling comprises a spring-biased locking mechanism.

9. The convertible high chair of claim 1, wherein the second arm comprises a plunger and the second shoulder comprises a channel, wherein the plunger is configured to fit within the channel.

* * * * *